US012241137B2

(12) United States Patent
Obata et al.

(10) Patent No.: US 12,241,137 B2
(45) Date of Patent: Mar. 4, 2025

(54) HIGH-STRENGTH COLD-ROLLED STEEL SHEET AND PRODUCTION METHOD FOR SAME

(71) Applicant: JFE Steel Corporation, Tokyo (JP)

(72) Inventors: Yoshie Obata, Tokyo (JP); Katsutoshi Takashima, Tokyo (JP); Takeshi Yokota, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 761 days.

(21) Appl. No.: 17/420,216

(22) PCT Filed: Dec. 23, 2019

(86) PCT No.: PCT/JP2019/050284
§ 371 (c)(1),
(2) Date: Jul. 1, 2021

(87) PCT Pub. No.: WO2020/145108
PCT Pub. Date: Jul. 16, 2020

(65) Prior Publication Data

US 2022/0064752 A1 Mar. 3, 2022

(30) Foreign Application Priority Data

Jan. 9, 2019 (JP) ..... 2019-001975

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 18/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/60*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C21D 9/46* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0273* (2013.01); *C22C 18/04* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/26* (2013.01); *C22C 38/28* (2013.01); *C22C 38/32* (2013.01); *C22C 38/38* (2013.01); *C22C 38/60* (2013.01); *C23C 2/06* (2013.01); *C23C 2/28* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2015/0013716 | A1 | 1/2015 | Masuoka et al. | |
| 2016/0177427 | A1* | 6/2016 | Takashima | C22C 38/08 148/330 |
| 2018/0037969 | A1 | 2/2018 | Yoshioka et al. | |
| 2018/0171459 | A1 | 6/2018 | Drillet et al. | |
| 2019/0003002 | A1* | 1/2019 | Seo | C23C 30/00 |
| 2019/0071744 | A1 | 3/2019 | Hasegawa et al. | |
| 2019/0203315 | A1 | 7/2019 | Obata et al. | |
| 2019/0203316 | A1* | 7/2019 | Minami | C22C 38/38 |

FOREIGN PATENT DOCUMENTS

| | | | |
|---|---|---|---|
| CN | 104053820 | A | 9/2014 |
| CN | 107429344 | A | 12/2017 |
| CN | 108884537 | A | 11/2018 |
| EP | 2803747 | A1 | 11/2014 |
| EP | 3012339 | A1 | 4/2016 |
| EP | 3178949 | A1 | 6/2017 |
| EP | 3187601 | A1 | 7/2017 |
| EP | 3187613 | A1 | 7/2017 |

(Continued)

OTHER PUBLICATIONS

Chinese Office Action with Search Report for Chinese Application No. 201980087619.1, dated Apr. 29, 2022, 11 pages.

(Continued)

*Primary Examiner* — Xiaowei Su
(74) *Attorney, Agent, or Firm* — Buchanan Ingersoll & Rooney PC

(57) ABSTRACT

A high-strength cold rolled steel sheet has a specific composition and a steel structure that is, by volume %, 10%-70% ferrite, 1%-10% retained austenite, 10%-60% bainite, and 2%-50% martensite, the average crystal grain size of the ferrite being no more than 6.0 μm, the average crystal grain size of the retained austenite being no more than 4.0 μm, the average crystal grain size of the bainite being no more than 6.0 μm, and the average crystal grain size of the martensite being no more than 4.0 μm. The concentration ratio of the average concentration of Si to a depth of 10 μm from the surface of the high-strength cold-rolled steel sheet to the average concentration of Si throughout the high-strength cold-rolled steel sheet is, by mass ratio, greater than 1.00 but less than 1.30.

14 Claims, No Drawings

(56) References Cited

FOREIGN PATENT DOCUMENTS

| | | | | |
|---|---|---|---|---|
| EP | 3228722 | A1 | 10/2017 | |
| EP | 3421633 | A1 | 1/2019 | |
| JP | 2002294398 | A | 10/2002 | |
| JP | 3956550 | | 8/2007 | |
| JP | 2010059452 | A | 3/2010 | |
| JP | 2018521222 | A | 8/2018 | |
| KR | 20180120210 | A | 11/2018 | |
| WO | 2017203994 | A1 | 11/2017 | |
| WO | 2018043456 | A1 | 3/2018 | |
| WO | WO-2018043473 | A1 * | 3/2018 | ..... B32B 15/013 |

OTHER PUBLICATIONS

International Search Report and Written Opinion for International Application No. PCT/JP2019/050284, dated Mar. 17, 2020, 5 pages.
Japanese Office Action with Concise Statement of Relevance for Japanese Application No. 2020-520172, dated Jul. 28, 2020, with partial translation, 4 pages.
Korean Office Action for Korean Application No. 10-2021-7020263, dated Aug. 16, 2022, with Concise Statement of Relevance of Office Action, 7 pages.
Extended European Search Report for European Application No. 19908644.8, dated Sep. 16, 2021, 12 pages.

* cited by examiner

HIGH-STRENGTH COLD-ROLLED STEEL SHEET AND PRODUCTION METHOD FOR SAME

CROSS REFERENCE TO RELATED APPLICATIONS

This is the U.S. National Phase application of PCT/JP2019/050284, filed Dec. 23, 2019, which claims priority to Japanese Patent Application No. 2019-001975, filed Jan. 9, 2019, the disclosures of these applications being incorporated herein by reference in their entireties for all purposes.

FIELD OF THE INVENTION

The present invention relates to a high strength cold rolled steel sheet having a tensile strength (TS) of not less than 980 MPa and being suitable for automotive parts, and a method of manufacturing the same.

BACKGROUND OF THE INVENTION

In the automotive field, while improvements in the fuel efficiency through reduction of the vehicle body weight are pursued, it has been encouraged to thin automotive parts through the use of high strength cold rolled steel sheets, and application of the high strength cold rolled steel sheets having a tensile strength (TS) of not less than 980 MPa is proceeding. Structural members and reinforcement members of automobiles require excellent formability, and to form a part in complicated shape, it is required to manufacture a steel sheet having both high ductility and high stretch flangeability (hole expandability). In addition, automobile steel sheets are joined by mostly resistance welding (spot welding) and hence also require excellent resistance weldability (less occurrence of cracks at a heat-affected portion during resistance welding).

For instance, claim 1 of Patent Literature 1 discloses:

"A high-tension galvanized steel sheet having excellent surface-breaking resistance during resistance welding, obtained by galvanizing a steel sheet having a chemical composition of, by mass %, C: 0.015 to 0.072%, Si: not more than 1.2%, Mn: 0.5 to 3.0%, P: not more than 0.020%, S: not more than 0.030%, and sol. Al: 0.002 to 1.20%, where amounts of Si, sol. Al and Mn satisfy the relationship expressed by the following formula, $$Si+sol\cdot Al+0.4\times Mn\leq 1.4\%,$$

with the balance being Fe and inevitable impurities, and the steel sheet having a tensile strength of not less than 450 MPa." Patent Literature 1 describes that the above-described steel sheet is excellent in resistance weldability.

PATENT LITERATURE

Patent Literature 1: JP 2002-294398 A

SUMMARY OF THE INVENTION

Under the forgoing circumstances, the inventors of the present invention have manufactured a cold rolled steel sheet with reference to Patent Literature 1, and consequently it was revealed that the thus manufactured steel sheet would not necessarily satisfy the required levels of today in terms of strength, ductility, hole expandability and resistance weldability.

Accordingly, in view of the situation as described above, an object according to aspects of the present invention is to provide a high strength cold rolled steel sheet having high strength as well as excellent ductility, hole expandability and resistance weldability, and a method of manufacturing the same.

As a high strength cold rolled steel sheet having excellent formability, a DP steel sheet in which soft ferrite and hard martensite are combined and a TRIP steel sheet containing retained austenite are known. However, the study conducted by the inventors of the present invention revealed that when plastic deformation proceeds in these steel sheets due to, for example, a tensile test and a hole expanding test, voids are generated at an interface between martensite in the steel sheet structure or martensite formed from retained austenite through work-induced transformation and soft ferrite, and the voids are joined together to grow into cracks. In other words, it has been found that volume fractions of hard phase and soft phase, grain sizes and other factors affect occurrence of voids and their behavior of joining and are highly correlated with formability of the steel sheet.

The study conducted by the inventors of the present invention also revealed that it is necessary to add Si or the like to achieve both excellent ductility and excellent hole expandability, and, on the other hand, if an amount of Si in a surface portion of a steel sheet is excessive, the melting point of zinc or the like (derived from, for example, a galvanizing layer) would not increase and the metal would melt to cause liquid metal embrittlement, whereby breakage may sometimes occur near a resistance welded part in the steel sheet.

Aspects of the present invention have been made on the basis of these findings, and the specific constitution thereof is as described below.

(1) A high strength cold rolled steel sheet having a composition including: by mass, C in an amount of not less than 0.04% but not more than 0.16%;

Si in an amount of not less than 0.15% but not more than 1.25%;

Mn in an amount of not less than 2.00% but not more than 3.50%;

P in an amount of not more than 0.050%;

S in an amount of not more than 0.0050%;

N in an amount of not more than 0.0100%;

Al in an amount of not less than 0.010% but not more than 2.000%;

Ti in an amount of not less than 0.005% but not more than 0.075%;

Nb in an amount of not less than 0.005% but not more than 0.075%; and

B in an amount of not less than 0.0002% but not more than 0.0040%, with the balance being Fe and inevitable impurities, and a steel structure including: by volume fraction, ferrite of not less than 10% but not more than 70%; retained austenite of not less than 1% but not more than 10%; bainite of not less than 10% but not more than 60%; and martensite of not less than 2% but not more than 50%, wherein the ferrite has an average grain size of not more than 6.0 μm, the retained austenite has an average grain size of not more than 4.0 μm, the bainite has an average grain size of not more than 6.0 μm, and the martensite has an average grain size of not more than 4.0 μm, and wherein a concentration ratio of an average Si concentration in a region extending from a surface up to 10 μm in a depth direction in the high strength cold rolled steel sheet to an average Si concentration in a whole of the high strength cold rolled steel sheet is more than 1.00 but less than 1.30 by mass ratio.

(2) The high strength cold rolled steel sheet according to claim 1, further including at least one element selected from the group consisting of: by mass, V in an amount of not less than 0.005% but not more than 0.200%; Cr in an amount of not less than 0.05% but not more than 0.20%; Mo in an amount of not less than 0.01% but not more than 0.20%; Cu in an amount of not less than 0.05% but not more than 0.20%; Ni in an amount of not less than 0.01% but not more than 0.20%; Sb in an amount of not less than 0.002% but not more than 0.100%; Sn in an amount of not less than 0.002% but not more than 0.100%; Ca in an amount of not less than 0.0005% but not more than 0.0050%; Mg in an amount of not less than 0.0005% but not more than 0.0050%; and REM in an amount of not less than 0.0005% but not more than 0.0050%, with the balance being Fe and inevitable impurities.

(3) The high strength cold rolled steel sheet according to claim 1 or 2, wherein a concentration ratio of an average Mn concentration in a region extending from a surface up to 10 μm in a depth direction in the high strength cold rolled steel sheet to an average Mn concentration in a whole of the high strength cold rolled steel sheet is more than 1.00 but less than 1.30 by mass ratio.

(4) The high strength cold rolled steel sheet according to any one of claims 1 to 3, wherein the high strength cold rolled steel sheet has one of a galvanizing layer, a galvannealing layer and an electrogalvanizing layer on its surface.

(5) A method of manufacturing the high strength cold rolled steel sheet according to any one of claims 1 to 4, wherein a steel slab having the composition according to claim 1 or 2 is subjected to at least one pass of hot rolling at a hot rolling starting temperature of not lower than 1,000° C. but not higher than 1,300° C., a finish rolling temperature of not lower than 800° C. but not higher than 1,000° C. and a rolling reduction of not less than 35%, subsequently cooled in a temperature range from 700° C. to a cooling stop temperature under a condition of an average cooling rate of not lower than 5° C./s but not higher than 50° C./s to reach a cooling stop temperature of not higher than 600° C., then coiled at a coiling temperature of not less than 350° C. but not higher than 600° C., subsequently subjected to pickling and thereafter cold rolling at a cold rolling rate of not less than 30%, in a subsequent annealing step, retained at an annealing temperature of not lower than 750° C. but not higher than 900° C. for not less than 10 seconds but not more than 300 seconds, then cooled at a cooling rate of not less than 5° C./s to reach a cooling stop temperature of not lower than 300° C. but not higher than 450° C. and subsequently retained at the cooling stop temperature for not less than 10 seconds but not more than 1,800 seconds, and thereafter subjected to oxidizing treatment and further pickling.

(6) The method according to claim 5, wherein the pickling after the oxidizing treatment is followed by galvanizing treatment, treatment involving galvanizing and alloying, or electrogalvanizing treatment.

As described below, aspects of the present invention can provide a high strength cold rolled steel sheet having high strength as well as excellent ductility, hole expandability and resistance weldability, and a method of manufacturing the same.

DETAILED DESCRIPTION OF EMBODIMENTS OF THE INVENTION

The high strength cold rolled steel sheet according to aspects of the invention and the method of manufacturing the same are described below.

In the description, the numerical ranges indicated using "(from) . . . to . . . " include the former number as the lower limit value and the latter number as the upper limit value.

[High Strength Cold Rolled Steel Sheet]

The high strength cold rolled steel sheet according to aspects of the invention (hereinafter, also called "steel sheet according to aspects of the invention") is:

a high strength cold rolled steel sheet (for instance, a high strength cold rolled thin steel sheet) having a composition including: by mass, C in an amount of not less than 0.04% but not more than 0.16%;

Si in an amount of not less than 0.15% but not more than 1.25%;

Mn in an amount of not less than 2.00% but not more than 3.50%;

P in an amount of not more than 0.050%;

S in an amount of not more than 0.0050%;

N in an amount of not more than 0.0100%;

Al in an amount of not less than 0.010% but not more than 2.000%;

Ti in an amount of not less than 0.005% but not more than 0.075%;

Nb in an amount of not less than 0.005% but not more than 0.075%; and

B in an amount of not less than 0.0002% but not more than 0.0040%, with the balance being Fe and inevitable impurities, and a steel structure including: by volume fraction, ferrite of not less than 10% but not more than 70%; retained austenite of not less than 1% but not more than 10%; bainite of not less than 10% but not more than 60%; and martensite of not less than 2% but not more than 50%, wherein the ferrite has an average grain size of not more than 6.0 μm, the retained austenite has an average grain size of not more than 4.0 μm, the bainite has an average grain size of not more than 6.0 μm, and the martensite has an average grain size of not more than 4.0 μm, and wherein a concentration ratio of an average Si concentration in a region extending from a surface up to 10 μm in a depth direction in the high strength cold rolled steel sheet to an average Si concentration in a whole of the high strength cold rolled steel sheet is more than 1.00 but less than 1.30 by mass ratio.

[Component Composition]

The component composition of the steel sheet according to aspects of the invention is described first. The percentage (%) used in the component composition means "mass %" unless otherwise noted.

<C: Not Less than 0.04% but not More than 0.16%>

C has a high solid-solution strengthening ability, is effective in increasing strength of a steel sheet and contributes to formation of retained austenite, bainite and martensite in accordance with aspects of the invention. To achieve those effects, C needs to be contained in an amount of not less than 0.04%. When an amount of C is less than 0.04%, it is difficult to obtain retained austenite and martensite as desired. On the other hand, C contained in an amount exceeding 0.16% causes excessive generation of retained austenite and martensite, thereby impairing ductility and hole expandability, and further impairing weldability. Accordingly, an amount of C is set to be not less than 0.04% but not more than 0.16%. For a 980-MPa class, an amount of C is preferably not less than 0.04% but less than 0.10% and more preferably not less than 0.06% but not more than 0.095%, because the effect according to aspects of the invention is more excellent. For a 1180-MPa class, an amount of C is preferably not less than 0.10% but not more than 0.16% and more preferably not less than 0.12% but not more than 0.15%, because the effect according to aspects of the invention is more excellent.

Here, the 980-MPa class means that the tensile strength (TS) is not less than 980 MPa but less than 1180 MPa; and the 1180-MPa class means that the tensile strength (TS) is not less than 1180 MPa.

<Si: Not Less than 0.15% but not More than 1.25%>

Si has a high solid-solution strengthening ability in ferrite, thus contributing to an increase in strength of a steel sheet, and suppresses generation of a carbide (cementite), thus contributing to stabilization of retained austenite. In addition, Si present in the state of solid solution in ferrite improves work hardenability, thus contributing to improvement in ductility of the ferrite itself. To achieve those effects, Si needs to be contained in an amount of not less than 0.15%. On the other hand, when an amount of Si exceeds 1.25%, the contribution to stabilization of retained austenite is saturated, and in addition weldability is impaired. Accordingly, an amount of Si is set to a range of not less than 0.15% but not more than 1.25%. Note that for the 980-MPa class, an amount of Si is preferably not less than 0.25% but not more than 1.15%, because the effect according to aspects of the invention is more excellent. For the 1180-MPa class, an amount of Si is preferably not less than 0.30% but not more than 1.25% and more preferably not less than 0.4% but not more than 1.15%, because the effect according to aspects of the invention is more excellent.

<Mn: Not Less than 2.00% but not More than 3.50%>

Mn contributes to an increase in strength of a steel sheet through the solid-solution strengthening or improvement in hardenability and, in addition, serves as an austenite stabilizing element, thus being an essential element required to secure the desired retained austenite. To achieve those effects, Mn needs to be contained in an amount of not less than 2.00%. On the other hand, Mn contained in an amount exceeding 3.50% impairs weldability and also leads to excessive generation of retained austenite and martensite to additionally impair hole expandability. In addition, when Mn is contained in an excessive amount, Mn segregation occurs, and the Mn concentration in a steel sheet surface layer increases, thus impairing weldability. Accordingly, an amount of Mn is set to a range of not less than 2.00% but not more than 3.50%. Note that for the 980-MPa class, an amount of Mn is preferably not less than 2.20% but not more than 3.30%, because the effect according to aspects of the invention is more excellent. For the 1180-MPa class, an amount of Mn is preferably not less than 2.00% but not more than 3.00% and more preferably not less than 2.20% but not more than 2.80%, because the effect according to aspects of the invention is more excellent.

<P: Not More than 0.050%>

P is an element that contributes to an increase in strength of a steel sheet through the solid-solution strengthening. On the other hand, P contained in an amount exceeding 0.050% impairs weldability and also promotes the grain boundary fracture due to grain boundary segregation. Accordingly, an amount of P is set to be not more than 0.050%.

<S: Not More than 0.0050%>

S is an element that is segregated in the grain boundary and thus embrittles the steel during the hot working, and that exists in the steel as a sulfide such as MnS and impairs local deformability. S contained in an amount exceeding 0.0050% impairs hole expandability. Accordingly, an amount of S is limited to not more than 0.0050%.

<N: Not More than 0.0100%>

N is an element that exists in the steel as a nitride and impairs local deformability. N contained in an amount exceeding 0.0100% impairs hole expandability. Accordingly, an amount of N is limited to not more than 0.0100%.

<Al: Not Less than 0.010% but not More than 2.000%>

Al is a ferrite generating element and is an element that, as with Si, suppresses generation of a carbide (cementite), thus contributing to stabilization of retained austenite. To achieve this effect, Al needs to be contained in an amount of not less than 0.010%. On the other hand, an amount of Al is limited to not more than 2.000% since the effect is saturated when Al is contained in an amount exceeding 2.000%. An amount of Al is preferably not less than 0.015% but not more than 1.500% and more preferably not less than 0.020% but not more than 1.000%, because the effect according to aspects of the invention is more excellent.

<Ti: Not Less than 0.005% but not More than 0.075%>

Ti is an element that not only forms fine carbides or nitrides but suppresses the coarsening of crystal grains and refines the steel sheet structure after the heating process, thus contributing to an increase in strength. Addition of Ti is also effective in preventing B from reacting with N. To achieve those effects, Ti needs to be contained in an amount of not less than 0.005%. On the other hand, when Ti is contained in an amount exceeding 0.075%, carbides and nitrides are excessively generated, thus impairing ductility. Accordingly, an amount of Ti is set to a range of not less than 0.005% but not more than 0.075%. An amount of Ti is preferably not less than 0.010% but not more than 0.065% and more preferably not less than 0.020% but not more than 0.050%, because the effect according to aspects of the invention is more excellent.

<Nb: Not Less than 0.005% but not More than 0.075%>

Nb not only forms fine carbides or nitrides but suppresses the coarsening of crystal grains and refines the steel sheet structure after the heating process, thus contributing to an increase in strength. To achieve those effects, Nb needs to be contained in an amount of not less than 0.005%. On the other hand, when Nb is contained in an amount exceeding 0.075%, carbides and nitrides are excessively generated, thus impairing ductility. Accordingly, an amount of Nb is set to a range of not less than 0.005% but not more than 0.075%. An amount of Nb is preferably not less than 0.010% but not more than 0.065% and more preferably not less than 0.020% but not more than 0.050%.

<B: Not Less than 0.0002% but not More than 0.0040%>

B is an element that is effective in improving hardenability and contributing to an increase in strength. To achieve those effects, B needs to be contained in an amount of not less than 0.0002%. On the other hand, when B is contained in an amount exceeding 0.0040%, martensite is excessively generated, thus impairing ductility and hole expandability. Accordingly, an amount of B is set to a range of not less than 0.0002% but not more than 0.0040%. An amount of B is preferably not less than 0.0005% but not more than 0.0035% and more preferably not less than 0.0010% but not more than 0.0030%, because the effect according to aspects of the invention is more excellent.

<Others>

While the basic components are as described above, in addition to the basic composition, aspects of the invention may further include at least one element selected from the group consisting of: V in an amount of not less than 0.005% but not more than 0.200%, Cr in an amount of not less than 0.05% but not more than 0.20%, Mo in an amount of not less than 0.01% but not more than 0.20%, Cu in an amount of not less than 0.05% but not more than 0.20%, Ni in an amount of not less than 0.01% but not more than 0.20%, Sb in an amount of not less than 0.002% but not more than 0.100%, Sn in an amount of not less than 0.002% but not more than 0.100%, Ca in an amount of not less than 0.0005% but not more than 0.0050%, Mg in an amount of not less than 0.0005% but not more than 0.0050%, and REM in an amount of not less than 0.0005% but not more than 0.0050%.

V generates V-based precipitates, thereby contributing to an increase in strength of a steel sheet as well as to the grain fining and homogenization of the steel sheet structure. To achieve those effects, V needs to be contained in an amount not less than 0.005%. On the other hand, when V is contained in an amount exceeding 0.200%, V-based precipitates are excessively generated, thus possibly impairing ductility in some cases. Accordingly, in a case where V is contained, an amount thereof is preferably limited to a range of not less than 0.005% but not more than 0.200%.

Cr contributes to an increase in strength of a steel sheet through the solid-solution strengthening, while improving hardenability and promoting generation of martensite to thereby contribute to an increase in strength. To achieve those effects, Cr needs to be contained in an amount of not less than 0.05%. On the other hand, when Cr is contained in an amount exceeding 0.20%, martensite is excessively generated, thus possibly impairing ductility and hole expandability in some cases. Accordingly, in a case where Cr is contained, an amount thereof is preferably limited to a range of not less than 0.05% but not more than 0.20%.

Mo contributes to an increase in strength of a steel sheet through the solid-solution strengthening, while improving hardenability and promoting generation of martensite to thereby contribute to an increase in strength.

To achieve those effects, Mo needs to be contained in an amount of not less than 0.01%. On the other hand, when Mo is contained in an amount exceeding 0.20%, martensite is excessively generated, thus possibly impairing ductility and hole expandability in some cases. Accordingly, in a case where Mo is contained, an amount thereof is preferably limited to a range of not less than 0.01% but not more than 0.20%.

Cu contributes to an increase in strength of a steel sheet through the solid-solution strengthening, while improving hardenability and promoting generation of martensite to thereby contribute to an increase in strength. To achieve those effects, Cu needs to be contained in an amount of not less than 0.05%. On the other hand, when Cu is contained in an amount exceeding 0.20%, the strength increasing effect may become so high that ductility and hole expandability may be impaired in some cases. Accordingly, in a case where Cu is contained, an amount thereof is preferably limited to a range of not less than 0.05% but not more than 0.20%.

Ni is an element that stabilizes retained austenite and is effective in securing good ductility of a cold rolled steel sheet, and that increases strength through the solid-solution strengthening when a cold rolled steel sheet is formed. In order to achieve those effects of addition, an amount of Ni is preferably not less than 0.01%. On the other hand, when Ni is contained in an amount exceeding 0.20%, the area ratio of hard martensite may be too great in some cases. This may also result in an increase in the cost. Accordingly, when Ni is added, an amount of Ni is preferably not less than 0.01% but not more than 0.20%.

Sb and Sn have the effect of suppressing decarburization in a steel sheet surface layer (the region of about several tens of micrometers) caused by nitridization or oxidation of the surface of the steel sheet. By suppressing such nitridization or oxidation of the steel sheet surface layer, an amount of martensite generated at the surface of the steel sheet can be prevented from decreasing, which is effective in ensuring the desired steel sheet strength. To achieve those effects, Sb and Sn each need to be contained in an amount of not less than 0.002%. On the other hand, those effects are saturated when Sb and Sn are each contained in an amount exceeding 0.100%. Accordingly, in a case where Sb and Sn are contained, amounts thereof are each preferably limited to a range of not less than 0.002% but not more than 0.100%.

All of Ca, Mg and Rare Earth Metals (REMs) are elements that are used in deoxidation and, besides, that spheroidize the shapes of sulfides and are effective in reducing adverse effects of the sulfides on local ductility and hole expandability. To achieve those effects, Ca, Mg and REMs each need to be contained in an amount of not less than 0.0005%. On the other hand, when Ca, Mg and REMs are each excessively contained in an amount exceeding 0.0050%, an amount of inclusion may be increased, which may cause surface and internal defects to impair ductility and hole expandability in some cases. Accordingly, in a case where Ca, Mg and REMs are contained, amounts thereof are each preferably limited to a range of not less than 0.0005% but not more than 0.0050%.

<Balance>

The balance except the above-described components consists of Fe and inevitable impurities.

[Steel Structure]

Next, a steel structure (microstructure) of the steel sheet according to aspects of the invention is described.

<Ferrite: Volume Fraction of not Less than 10% but not More than 70%, and Average Grain Size of not More than 6.0 μm>

Ferrite is a structure that contributes to improvement in ductility (elongation). To achieve the effect, the volume fraction of ferrite needs to be not less than 10%. On the other hand, when the volume fraction exceeds 70%, it is difficult to obtain the TS of not less than 980 MPa; therefore, the volume fraction of ferrite is set to a range of not less than 10% but not more than 70%. For the 1180-MPa class, the fraction volume of ferrite is preferably not less than 10% but not more than 30%, because the effect according to aspects of the invention is more excellent.

In addition, when the average grain size of ferrite exceeds 6.0 μm, voids having been generated on a punctured and fractured surface that is formed in the hole expanding process are likely to be joined together during the hole expanding process; therefore, it is not possible to obtain good hole expandability. Accordingly, the average grain size of ferrite is set to a range of not more than 6.0 μm. For the 1180-MPa class, the average grain size of ferrite is preferably not more than 4.0 μm, because the effect according to aspects of the invention is more excellent.

<Retained Austenite: Volume Fraction of not Less than 1% but not More than 10%, and Average Grain Size of not More than 4.0 μm>

Retained austenite is a structure that contributes to improvement in ductility through its strain-induced transformation, thus leading to the improved ductility as well as the improved balance between strength and ductility. To achieve those effects, the volume fraction of retained austenite needs to be not less than 1%. On the other hand, when the volume fraction is increased to exceed 10%, hole expandability is impaired. Accordingly, the volume fraction of retained austenite is set to a range of not less than 1% but not more than 10%.

In addition, when the average grain size of retained austenite exceeds 4.0 μm, voids having been generated in the hole expanding test are likely to grow, thus impairing hole expandability. Accordingly, the average grain size of retained austenite is set to a range of not more than 4.0 μm. For the 1180-MPa class, the average grain size of retained austenite is preferably not more than 2.0 μm, because the effect according to aspects of the invention is more excellent.

<Bainite: Volume Fraction of not Less than 10% but not More than 60%, and Average Grain Size of not More than 6.0 μm>

Bainite is a structure that contributes to improvement in hole expandability. Accordingly, the volume fraction in the structure is set to a range of not less than 10% but not more than 60%. For the 1180-MPa class, the fraction volume of bainite is preferably not less than 20% but not more than 60%, because the effect according to aspects of the invention is more excellent.

In addition, when the average grain size of bainite exceeds 6.0 μm, voids having been generated in a vicinity of a punctured and fractured surface that is formed in the hole expanding process are likely to be joined together during the hole expanding process; therefore, it is not possible to obtain good hole expandability. Accordingly, the average grain size of bainite is set to a range of not more than 6.0 μm. For the 1180-MPa class, the average grain size of bainite is preferably not more than 4.0 μm, because the effect according to aspects of the invention is more excellent.

<Martensite: Volume Fraction of not Less than 2% but not More than 50%, and Average Grain Size of not More than 4.0 μm>

In order to obtain the tensile strength of not less than 980 MPa, not less than 2% of martensite in terms of volume fraction is required. On the other hand, when the volume fraction exceeds 50%, voids are likely to be generated at an interface with ferrite during the hole expanding test, thus lowering the hole expanding ratio. Accordingly, the volume fraction of martensite is set to a range of not less than 2% but not more than 50%. For the 980-MPa class, the fraction volume of martensite is preferably not less than 2% but not more than 40%, because the effect according to aspects of the invention is more excellent.

In addition, when the average grain size of martensite exceeds 4.0 μm, voids having been generated in the hole expanding test are likely to grow, thus impairing hole expandability. Accordingly, the average grain size of martensite is set to a range of not more than 4.0 μm. For the 1180-MPa class, the average grain size of martensite is preferably not more than 3.0 μm, because the effect according to aspects of the invention is more excellent.

Furthermore, while non-recrystallized ferrite, perlite or cementite may be generated in addition to the above-described structures in some cases, the object according to aspects of the invention can be attained as long as the structures specified as above are satisfied. Meanwhile, it is preferable that, in terms of volume fraction, non-recrystallized ferrite accounts for not more than 10%, perlite not more than 5%, cementite not more than 5%, and tempered martensite less than 20%, because the effect according to aspects of the invention is more excellent.

PREFERRED EMBODIMENTS

In the steel sheet according to aspects of the invention, for the 980-MPa class, it is preferable that:

- an amount of C is, by mass, not less than 0.04% but less than 0.10%, and the volume fraction of martensite is not less than 2% but not more than 40%, because the effect according to aspects of the invention is more excellent.

In addition, in the steel sheet according to aspects of the invention, for the 1180-MPa class, it is preferable that:

- an amount of C is, by mass, not less than 0.10% but not more than 0.16%,
- an amount of Si is, by mass, not less than 0.30% but not more than 1.25%,
- an amount of Mn is, by mass, not less than 2.00% but not more than 3.00%,
- the volume fraction of ferrite is not less than 10% but not more than 30%,
- the volume fraction of bainite is not less than 20% but not more than 60%,
- the average grain size of ferrite is not more than 4.0 μm,
- the average grain size of retained austenite is not more than 2.0 μm,
- the average grain size of bainite is not more than 4.0 μm, and
- the average grain size of martensite is not more than 3.0 μm, because the effect according to aspects of the invention is more excellent.

[Concentration Ratio]

<Si Concentration Ratio>

As described above, in the steel sheet according to aspects of the invention, a concentration ratio of an average Si concentration in a region extending from a surface up to 10 μm in the depth direction in the high strength cold rolled steel sheet to an average Si concentration in a whole of the high strength cold rolled steel sheet is more than 1.00 but less than 1.30 in terms of mass ratio. Hereinbelow, the foregoing concentration ratio is also referred to as "Si concentration ratio."

The steel sheet according to aspects of the invention has excellent balance between strength, ductility, hole expandability and resistance weldability (scarce occurrence of cracks during resistance welding) probably because the Si concentration ratio is held in the above-described range. The reason why resistance weldability is excellent is probably because liquid metal embrittlement hardly occurs.

The Si concentration ratio is preferably not more than 1.25, more preferably not more than 1.20 and even more preferably not more than 1.15, because the effect according to aspects of the invention is more excellent. The lower limit of the Si concentration ratio is preferably not less than 1.05 and more preferably not less than 1.10, because the effect according to aspects of the invention is more excellent.

The average Si concentration in the whole high strength cold rolled steel sheet refers to the Si component composition as described above.

<Mn Concentration Ratio>

In the steel sheet according to aspects of the invention, a concentration ratio of an average Mn concentration in a region extending from a surface up to 10 μm in the depth direction in the high strength cold rolled steel sheet to an average Mn concentration in a whole of the high strength cold rolled steel sheet is not particularly limited and is preferably more than 1.00 but less than 1.30 in terms of a mass ratio, because the effect according to aspects of the invention is more excellent. Hereinbelow, the foregoing concentration ratio is also referred to as "Mn concentration ratio."

The Mn concentration ratio is preferably not more than 1.25, more preferably not more than 1.20 and even more preferably not more than 1.15, because the effect according to aspects of the invention is more excellent. The lower limit of the Mn concentration ratio is preferably not less than 1.05 and more preferably not less than 1.10, because the effect according to aspects of the invention is more excellent.

The average Mn concentration in the whole high strength cold rolled steel sheet refers to the Mn component composition as described above.

<Si Concentration Ratio/Mn Concentration Ratio>

A ratio of the Si concentration ratio to the Mn concentration ratio (Si concentration ratio/Mn concentration ratio) is not particularly limited and is preferably 0.5 to 2, more preferably 0.8 to 1.2 and even more preferably 0.9 to 1.1, because the effect according to aspects of the invention is more excellent.

[Plating Layer]

The steel sheet according to aspects of the invention may further include a plating layer on its surface for improving corrosion resistance. Any one of a galvanizing layer, a galvannealing layer and an electrogalvanizing layer is preferably employed as the plating layer. Any known galvanizing layer, galvannealing layer or electrogalvanizing layer may be suitable as the galvanizing layer, the galvannealing layer or the electrogalvanizing layer.

[Sheet Thickness]

The sheet thickness of the steel sheet according to aspects of the invention is not particularly limited and, for example, is preferably not less than 0.1 mm but not more than 5.0 mm and more preferably not less than 0.5 mm but not more than 3.0 mm.

[Method of Manufacturing High Strength Cold Rolled Steel Sheet]

Next, a preferred method of manufacturing the steel sheet according to aspects of the invention (hereinafter also called "method according to aspects of the invention") is described below.

In the method according to aspects of the invention, a steel material having the foregoing composition sequentially undergoes a hot rolling step, a cold rolling step, an annealing step, an oxidizing step and a pickling step, whereby a high strength cold rolled steel sheet is obtained.

In the oxidizing step, Si, Mn and other elements on a surface are oxidized to be concentrated, and in the subsequent pickling step, oxides of Si, Mn and other elements are removed from the surface. The Si concentration ratio and the Mn concentration ratio can be controlled using the balance between the oxidizing step and the pickling step.

[Hot Rolling Step]

For a steel slab to be subjected to hot rolling, it is preferable that a molten steel having the foregoing composition is made by an ordinary smelting method using, for example, a converter and is formed into a cast slab (steel material) such as a slab having a predetermined dimension by a continuous casting method, because of scarce occurrence of component segregation. Meanwhile, a steel slab obtained by an ingot casting method or a thin slab casting method may be also used.

The steel material having the foregoing composition is subjected to the hot rolling step to turn into a hot rolled steel sheet.

In addition to the above method in which a steel material having the foregoing composition is reheated and hot rolled, the hot rolling step may employ, for example, a method in which a cast steel slab is not cooled but inserted into a heating furnace as a warm slab, reheated and rolled, a method in which a steel slab is not cooled but subjected to heat retention and immediately followed by rolling, or a method in which a steel slab is subjected to rolling immediately after casting.

<Hot Rolling Starting Temperature: Not Lower than 1,000° C. but not Higher than 1,300° C.>

When the hot rolling starting temperature is lower than 1,000° C., not only the rolling load is increased to lower the productivity, but it is difficult to eliminate segregation of elements in the slab. On the other hand, the hot rolling starting temperature of not lower than 1,300° C. merely increases the heating cost. Accordingly, the hot rolling starting temperature is set to a range of not lower than 1,000° C. but not higher than 1,300° C. The hot rolling starting temperature is preferably not lower than 1,100° C. but not higher than 1,300° C., because the effect according to aspects of the invention in the obtained steel sheet is more excellent. It should be noted that the description that "the effect according to aspects of the invention in the obtained steel sheet is more excellent" is hereinafter simply described as "the effect according to aspects of the invention is more excellent."

<Rolling Reduction: At Least One Pass of Rolling at not Less than 35%>

When the rolling reduction is less than 35%, recrystallization in an austenite region in the steel sheet is insufficient, causing an uneven steel sheet structure after the annealing step and besides a failure in elimination of segregation of elements. Accordingly, through at least one pass of rolling at a rolling reduction of not less than 35%, recrystallization is evenly promoted, and a fine steel sheet structure is obtained after the annealing step. On the other hand, when the rolling reduction exceeds 70%, the foregoing effect is saturated. Hence, the rolling reduction preferably has an upper limit of not more than 70%.

<Finish Rolling Temperature: Not Lower than 800° C. but not Higher than 1,000° C.>

When the finish rolling temperature is lower than 800° C., the steel sheet structure becomes uneven, and ductility or hole expandability after the annealing step are impaired. Accordingly, by setting the finish rolling temperature to not lower than 800° C., rolling is completed in a single phase region of austenite, and a homogeneous steel sheet structure can be obtained. On the other hand, when the finish rolling temperature exceeds 1,000° C., the structure of the hot rolled steel sheet becomes coarse, and it is impossible to obtain a structure having a desired grain size after the annealing step. Hence, the finish rolling temperature is set to not lower than 800° C. but not higher than 1,000° C.

<Average Cooling Rate from 700° C. to Cooling Stop Temperature after Hot Rolling: Not Lower than 5° C./s but not Higher than 50° C./s>

By setting the average cooling rate from 700° C. to the cooling stop temperature after hot rolling to not lower than 5° C./s but not higher than 50° C./s, the hot rolled steel sheet is controlled to a structure primarily including bainite. When the average cooling rate is lower than 5° C./s, ferrite or perlite is excessively generated in the structure of the hot rolled steel sheet. On the other hand, when the average cooling rate exceeds 50° C./s, the effect of suppressing generation of ferrite or perlite is saturated.

<Cooling Stop Temperature after Hot Rolling: Not Higher than 600° C.>

The cooling stop temperature after hot rolling is set to not higher than 600° C. When a steel sheet of the 980-MPa class is manufactured, the cooling stop temperature after hot rolling is preferably not higher than 500° C., because the effect according to aspects of the invention is more excellent.

<Coiling Temperature after Hot Rolling: Not Lower than 350° C. but not Higher than 600° C.>

After hot rolling, by setting the cooling stop temperature and the coiling temperature to not higher than 600° C. in addition to the above-described cooling conditions, the hot rolled steel sheet is homogenized to a bainite-based structure, the steel structure after the annealing step, in particular, ferrite, bainite and martensite are refined, and besides the quality of material in the sheet width direction becomes uniform. On the other hand, when the coiling temperature exceeds 600° C., since ferrite or perlite is excessively generated in the steel structure of the hot rolled steel sheet, the steel structure after the annealing step becomes inhomogeneous, and ferrite or martensite having a desired average grain size cannot be obtained. When the coiling temperature after hot rolling is not higher than 350° C., hard martensite is excessively generated in the structure of the hot rolled steel sheet, and the rolling load during cold rolling increases. When a steel sheet of the 980-MPa class is manufactured, the coiling temperature is preferably not lower than 350° C. but not higher than 450° C., because the effect according to aspects of the invention is more excellent. When a steel sheet of the 1180-MPa class is manufactured, the coiling temperature is preferably not lower than 400° C. but not higher than 600° C., because the effect according to aspects of the invention is more excellent.

<Pickling>

Subsequently, the obtained hot rolled steel sheet is subjected to pickling, whereby a scale in the steel sheet surface layer is removed. The pickling conditions are not necessarily limited, and regular pickling methods using, for example, hydrochloric acid or sulfuric acid are applicable.

[Cold Rolling Step]

The cold rolling step is a step of subjecting the hot rolled steel sheet having been pickled to cold rolling, thereby forming a cold rolled steel sheet having a predetermined sheet thickness.

<Cold Rolling Rate: Not Less than 30%>

In cold rolling, a working strain is introduced into the steel sheet, whereby recrystallization proceeds in the annealing temperature range in the subsequent annealing step, and the grain size of the final structure is controlled. When the cold rolling reduction is less than 30%, a working strain applied to the steel sheet is insufficient, and sufficient recrystallization is not achieved in the annealing step. Accordingly, the steel structure of the final structure has excessive non-recrystallized ferrite, thereby impairing ductility and hole expandability. The upper limit of the cold rolling rate is not particularly limited and is preferably not higher than 60%, because those effects are saturated when the rate exceeds 60%.

[Annealing Step]

The obtained cold rolled steel sheet is subsequently subjected to the annealing step.

The steel sheet is subjected to the annealing step in order to form desired ferrite, retained austenite, bainite and martensite in the steel sheet to thereby obtain a high strength cold rolled steel sheet having both high ductility and high hole expandability. In this annealing step, the steel sheet is heated to an annealing temperature of not lower than 750° C. but not higher than 900° C., cooled from the annealing temperature to the cooling stop temperature at a cooling rate of not lower than 5° C./s to reach a temperature of not lower than 300° C. but not higher than 450° C., and retained.

<Annealing Temperature: Not Lower than 750° C. but not Higher than 900° C.>

When the annealing temperature is lower than 750° C., since the volume fraction of austenite decreases during annealing, ferrite is excessively obtained, and in addition recrystallization does not sufficiently proceed so that non-crystallized ferrite also becomes excessive, impairing hole expandability. On the other hand, when the annealing temperature exceeds 900° C., austenite grains are excessively coarsened during annealing, making it difficult to obtain a desired grain size. Accordingly, the annealing temperature is set to not lower than 750° C. but not higher than 900° C. The annealing temperature is preferably not lower than 770° C. but not higher than 880° C., because the effect according to aspects of the invention is more excellent.

<Retaining Time at Annealing Temperature: Not Less than 10 Seconds but not More than 300 Seconds>

When the retaining time at the annealing temperature is less than 10 seconds, recrystallization does not sufficiently proceed, and in addition austenite is not sufficiently generated during annealing, whereby non-recrystallized ferrite and ferrite are excessively obtained at the end. Meanwhile, when the retaining time exceeds 300 seconds, the resulting steel sheet structure or mechanical properties are not affected, and Si or Mn tends to be concentrated in the steel sheet surface layer due to generation of oxides of elements such as Si or Mn. Accordingly, the retaining time at the annealing temperature is set to not less than 10 seconds but not more than 300 seconds.

<Average Cooling Rate from Annealing Temperature to Cooling Stop Temperature: Not Lower than 5° C./s>

When the average cooling rate from the annealing temperature to the cooling stop temperature is lower than 5° C./s, not only ferrite but also perlite is excessively generated during cooling. It should be noted that cooling is preferably gas cooling but may be a combination of furnace cooling, mist cooling, roll cooling, water cooling and other cooling methods.

<Cooling Stop Temperature: Not Lower than 300° C. but not Higher than 450° C.>

When the cooling stop temperature is lower than 300° C., since a large amount of martensite is generated at the time of cooling stop, ductility is impaired. On the other hand, when the cooling stop temperature exceeds 450° C., bainite finally obtained is excessive, and in addition generation of martensite is too small, making it difficult to obtain sufficient strength. Accordingly, the cooling stop temperature is set to not lower than 300° C. but not higher than 450° C.

<Retaining Time at Cooling Stop Temperature: Not Less than 10 Seconds but not More than 1,800 Seconds>

When the retaining time at the cooling stop temperature is less than 10 seconds, sufficient bainite transformation does not occur, and martensite finally obtained is excessive, impairing ductility. On the other hand, the retaining time exceeding 1,800 seconds does not affect the steel sheet structure. Accordingly, the retaining time at the cooling stop temperature is specified to be not less than 10 seconds but not more than 1,800 seconds.

In addition, cooling after retaining at the cooling stop temperature is not necessarily limited, and the steel sheet may be cooled to a desired temperature such as room temperature by any method, for instance, by being left to cool.

[Oxidizing Step]

The oxidizing step is a step of oxidizing the cold rolled steel sheet after the annealing step. Through this step, elements including Si and Mn on the steel sheet surface are oxidized, whereby Si, Mn or other elements on the surface are concentrated.

The oxidizing method is not particularly limited, and examples thereof include a method in which the steel sheet is left to stand in oxidizing atmosphere (such as air) (at 100° C. to 400° C. for 1 to 100 minutes, because the effect according to aspects of the invention is more excellent).

[Pickling Step]

The pickling step is a step of performing pickling on the cold rolled steel sheet after the oxidizing step. Through this step, oxides of elements such as Si and Mn in the steel sheet surface layer are removed, whereby the resistance weldability is improved. In the present description, the pickling step refers to pickling after the oxidizing step.

The pickling conditions are not necessarily limited, and any regular pickling method using, for example, hydrochloric acid or sulfuric acid is applicable, while it is preferable that pH is no lower than 1.0 but not higher than 4.0, the temperature not lower than 10° C. but not higher than 100° C. (particularly, not lower than 20° C. but not higher than 50° C.), and the immersion time not less than 5 seconds but not more than 200 seconds (particularly, not less than 5 seconds but not more than 50 seconds), because the effect according to aspects of the invention is more excellent.

First Preferred Embodiment

For the acid used in pickling, hydrochloric acid or sulfuric acid is preferably used, hydrochloric acid is more preferably used, and a combination of hydrochloric acid and sulfuric acid is further more preferably used, because the effect according to aspects of the invention is more excellent.

The concentration of the foregoing hydrochloric acid is not particularly limited, and is preferably 1 to 100 g/L and more preferably 10 to 20 g/L, because the effect according to aspects of the invention is more excellent. The concentration of the foregoing sulfuric acid is not particularly limited, and is preferably 1 to 300 g/L and more preferably 100 to 200 g/L, because the effect according to aspects of the invention is more excellent.

In a case where a combination of hydrochloric acid and sulfuric acid is used, the ratio (mass ratio) of hydrochloric acid/sulfuric acid is preferably 0.01 to 1.0, because the effect according to aspects of the invention is more excellent.

In addition, the temperature of pickling is preferably not lower than 10° C. but not higher than 100° C. (particularly, not lower than 20° C. but not higher than 50° C.), because the effect according to aspects of the invention is more excellent.

In addition, the pickling time is preferably not less than 5 seconds but not more than 200 seconds (particularly, not less than 5 seconds but not more than 50 seconds), because the effect according to aspects of the invention is more excellent.

Second Preferred Embodiment

In the pickling step, pickling (first pickling) is preferably followed by re-pickling (second pickling), because the effect according to aspects of the invention is more excellent.

(First Pickling)

The conditions of the first pickling are not particularly limited, and, for instance, the above-described first preferred embodiment is applicable.

(Second Pickling)

The acid used in the second pickling is not particularly limited, and examples thereof include hydrochloric acid, sulfuric acid, phosphoric acid, pyrophosphoric acid, formic acid, acetic acid, citric acid, hydrofluoric acid, oxalic acid and an acid obtained by mixing two or more thereof. While any of these may be used, hydrochloric acid or sulfuric acid commonly used in the steel industry can be preferably used, because the effect according to aspects of the invention is more excellent. Hydrochloric acid is particularly preferable because it rarely leaves residues on the steel sheet surface having been washed with water due to its volatility, unlike in the case of sulfuric acid which leaves residues such as sulfate radicals, and it also provides a large oxide-destruction effect owing to chloride ions. An acid obtained by mixing hydrochloric acid and sulfuric acid may be also used.

The re-pickling liquid preferably has a hydrochloric acid concentration of 0.1 g/L to 50 g/L when hydrochloric acid is used, and a sulfuric acid concentration of 0.1 g/L to 150 g/L when sulfuric acid is used, while a hydrochloric acid concentration and a sulfuric acid concentration are preferably 0.1 g/L to 20 g/L and 0.1 g/L to 60 g/L, respectively, when an acid obtained by mixing hydrochloric acid and sulfuric acid is used, because the effect according to aspects of the invention is more excellent. In addition, because the effect according to aspects of the invention is more excellent, the re-pickling in accordance with aspects of the invention is preferably performed with the re-pickling liquid having a temperature of 20° C. to 70° C. (particularly, 30° C. to 50° C.) for treatment time of 1 to 30 seconds, regardless of which of the foregoing re-pickling liquids is used.

[Other Steps]

The method according to aspects of the invention may perform temper rolling. The elongation rate in the temper rolling is not particularly specified and is preferably not less than 0.1% but not more than 2.0%, since excessive elongation impairs ductility.

In addition, plating treatment may follow the above-described pickling step to thereby form a plating layer on the surface. For the plating treatment, galvanizing treatment, treatment involving galvanizing and alloying, or electrogalvanizing treatment is preferred. Each of the galvanizing treatment, the treatment involving galvanizing and alloying, and the electrogalvanizing treatment may suitably employ a known treatment method.

EXAMPLES

Aspects of the invention are described below in further detail by way of examples. However, the invention should not be construed as being limited to the following examples.

[Manufacture of High Strength Cold Rolled Steel Sheet]

Molten steels having the component compositions shown in Table 1 below (with the balance being Fe and inevitable impurities) were each made in a converter, and steel slabs with a thickness of 230 mm were obtained through a continuous casting method. The steel slabs thus obtained were subjected to hot rolling under the conditions shown in Table 2, and thus hot rolled steel sheets were obtained. Thereafter, pickling (hydrochloric acid) was performed, followed by cold rolling performed at the cold rolling rates shown in Table 2, and annealing was further performed under the conditions shown in Table 2. In the examples where "YES" is shown in the spaces for "Oxidizing step" in Table 2, the oxidizing step (being left stand in air at 250° C. for 30 minutes) was performed. Thereafter, pickling was performed under the conditions shown in the spaces for "Pickling step" in Table 2. Meanwhile, in the examples where "NO" is shown in the spaces for "Pickling step" in Table 2, pickling was not performed. Cold rolled steel sheets were thus obtained.

<Pickling Step>

The pickling step shown in Table 2 is as described below.

(Condition 1)

Pickling is performed under the following conditions.

Acid: Hydrochloric acid (concentration: 15 g/L)

Temperature: 35° C.

Treatment time: 10 seconds (Condition 2)

After pickling under the following conditions of Condition (2-1) below, re-pickling is performed under the following conditions Condition (2-2).

Condition (2-1)

Acid: Hydrochloric acid (concentration: 15 g/L)+Sulfuric acid (concentration: 150 g/L)

Temperature: 35° C.

Treatment time: 10 seconds

Condition (2-2)

Acid: Hydrochloric acid (concentration: 10 g/L) Temperature: 35° C.

Treatment time: 10 seconds (Condition 3)

After pickling under the following conditions of Condition (3-1), re-pickling is performed under the following conditions of Condition (3-2). The only difference from Condition 2 is the temperature for the re-pickling.

Condition (3-1)

Acid: Hydrochloric acid (concentration: 15 g/L)+Sulfuric acid (concentration: 150 g/L)

Temperature: 35° C.

Treatment time: 10 seconds

Condition (3-2)

Acid: Hydrochloric acid (concentration: 10 g/L)

Temperature: 50° C.

Treatment time: 10 seconds

<Plating Treatment>

In the examples where "GI" is shown in the spaces for "Steel sheet type" in Table 3, after completion of the pickling step, galvanizing treatment was further performed to form galvanizing layers on the surfaces, whereby galvanized steel sheets (GI) were obtained. The galvanizing treatment was performed, using a continuous galvanizing line, by reheating the cold rolled and annealed steel sheet (CR) having undergone annealing to a temperature of 430° C. to 480° C. as needed and immersing the steel sheet in a galvanizing bath (bath temperature: 470° C.), whereby the resulting plating layer was adjusted to have a coating weight of 45 g/m$^2$ per one side. The galvanizing bath composition was Zn-0.18 mass % of Al. In the examples where "GA" is shown in the spaces for "Steel sheet type" in Table 3, the galvanizing bath composition was set to Zn-0.14 mass % of Al in the galvanizing treatment, and the steel sheets were alloyed at 520° C. after plating, whereby galvannealed steel sheets (GA) were obtained. The Fe concentration of the plating layer was set to not less than 9 mass % but not more than 12 mass %.

In the examples where "EG" is shown for the spaces for "Steel sheet type" in Table 3, after completion of the annealing step, electrogalvanizing treatment was further performed using an electrogalvanizing line such that the resulting coating weight was 30 g/m$^2$ per one side, whereby electrogalvanized steel sheets (EG) were obtained.

[Evaluation]

Specimens were taken from the obtained cold rolled steel sheets (including galvanized steel sheets, galvannealed steel sheets and electrogalvanized steel sheets) and were subjected to structure observation, a tensile test, a hole expanding test and a welding test. The test methods were as described below.

<Structure Observation>

First, a specimen for structure observation was taken from the center portion in the sheet width of the obtained cold rolled steel sheet, polished to have an observation surface in the position corresponding to ¼ of the sheet thickness in the rolling-direction cross section (L cross section), and etched (etched with 3 vol % Nital). The specimen was observed using a scanning electron microscope (SEM) at a magnification of 5000×, the obtained SEM image was subjected to image analysis to find the structure fraction (area ratio) of each phase, and the value thus found is treated as a volume fraction. In the image analysis, Image-Pro (trade name) available from Media Cybernetics Inc. was used as analysis software. In an SEM image, ferrite takes on a gray color, martensite, retained austenite and cementite take on a white color, and bainite takes on a color between gray and white, and hence the respective phases were determined based on their tones. Further, a structure in which carbides in the form of fine lines or dots were observed within ferrite was regarded as bainite. In addition, the obtained SEM image was subjected to image analysis to determine areas of ferrite grains and bainite grains, circle equivalent diameters were calculated from the areas, and values thereof were subjected to the arithmetic mean operation, whereby average grain sizes of ferrite and bainite were obtained.

Moreover, the site corresponding to the same observation field as the above SEM image was observed through SEM-EBSD (electron backscatter diffraction), and, within a structure taking on a white color in the SEM image, a structure identified as a bcc structure of Fe based on the phase map was treated as martensite. In addition, the obtained SEM image and phase map were subjected to image analysis to determine areas of martensite grains, circle equivalent diameters were calculated from the areas, and values thereof were subjected to the arithmetic mean operation, whereby an average grain size of martensite was obtained.

An average grain size of retained austenite was also obtained by observing the specimen using a transmission electron microscope (TEM) at a magnification of 15,000×, subjecting the obtained TEM image to image analysis to determine areas of retained austenite grains, calculating circle equivalent diameters based on the areas, and subjecting values thereof to the arithmetic mean operation.

In addition, a specimen for X-ray diffraction was taken from the obtained cold rolled steel sheet, ground and polished to have a measurement surface in the position corresponding to ¼ of the sheet thickness. Then, the volume fraction of retained austenite was determined from the diffracted X ray intensity through X-ray diffraction. The incident X-ray was CoKα. In the calculation of the volume fraction of retained austenite, the intensity ratio was calculated with every combination of integral intensities of peaks of {111}, {200}, {220} and {311} surfaces of austenite and {110}, {200} and {211} surfaces of ferrite, and the average of the results was obtained, whereby the volume fraction of retained austenite of the steel sheet was determined.

The results are shown in Table 3.

<Element Concentration Measurement in Region from Surface Up to Thickness of 10 μm>

An electron probe microanalyzer (EPMA) specimen for measurement of element concentration of a steel sheet surface portion was taken from the obtained cold rolled steel sheet and subjected to line analysis for three fields within a 10 μm range in the depth direction from the surface in the rolling-direction cross section (L cross section), and an average concentration of Si in a region extending from the surface up to 10 μm in the depth direction was determined. A concentration ratio of the average Si concentration in the region extending from the surface up to 10 μm in the depth direction to an average Si concentration in a whole of the steel sheet (component composition in Table 1) was then obtained. Turning to Mn, similarly, a concentration ratio of an average Mn concentration in the region extending from the surface up to 10 μm in the depth direction to an average Mn concentration in a whole of the steel sheet (component composition in Table 1) was obtained. The results are shown in Table 3.

<Tensile Test>

A JIS No. 5 specimen for tensile test was taken from the obtained cold rolled steel sheet such that the tensile direction was a direction (C direction) perpendicular to the rolling direction, a tensile test was performed in accordance with JIS Z 2241:2011, and the tensile properties (tensile strength TS, breaking elongation El) were determined. The results are shown in Table 3.

In this test, when TS≥980 MPa is satisfied, the steel sheet can be regarded as having high strength.

When El ≥15% is satisfied for the 980-MPa class or El ≥12% is satisfied for the 1180-MPa class, the steel sheet can be regarded as having excellent ductility.

<Hole Expanding Test>

A specimen of 100 mm W×100 mm L in size was taken from the obtained cold rolled steel sheet, a hole having a diameter of 10 mm was punched with a clearance of 12.5% in accordance with JIS Z 2256:2010, a conical punch having an apex angle of 60° was elevated to expand the hole, elevation of the punch was stopped when a crack penetrated in the sheet thickness direction, and the hole expanding ratio A (%) was measured based on the hole diameter after the crack penetration and the hole diameter prior to the test. The results are shown in Table 3. When A is not less than 35%, the steel sheet can be regarded as having excellent hole expandability.

<Welding Test>

A specimen of 150 mm W×50 mm L in size taken from the obtained cold rolled steel sheet and another specimen taken from a 590 MPa-class galvanized steel sheet were subjected to resistance welding (spot welding). Resistance spot welding was performed on a paired steel sheets, i.e., two steel sheets superposed on one another, by a servomotor pressurizing-type resistance welder attached to a welding gun using a single phase alternating current (50 Hz), with the paired steel sheets being inclined by 3°. For the welding conditions, the pressure was 4.0 kN, and a holding time was 0.2 seconds. The welding current and the welding time were adjusted such that the nugget diameter was 4 √t mm (t: thickness of cold rolled steel sheet). The specimen having been subjected to welding was cut into halves, a cross section thereof was observed with an optical microscope, and resistance weldability was evaluated based on the following evaluation criteria. The results are shown in Table 3. Practically, "Good" or "Fair" is preferable, and "Good" is more preferable.

Good: No crack of 0.3 mm or more was observed.

Fair: No crack of 0.4 mm or more was observed.

Poor: Crack of 0.4 mm or more was observed.

TABLE 1-1

| Steel | Component composition (mass %) | | | | | | | | | | | |
|---|---|---|---|---|---|---|---|---|---|---|---|---|
| type | C | Si | Mn | P | S | N | Al | Ti | Nb | B | Other component | Remarks |
| 1-A | 0.05 | 0.65 | 2.36 | 0.007 | 0.0014 | 0.0034 | 0.033 | 0.015 | 0.024 | 0.0005 | | Inventive steel |
| 1-B | 0.08 | 0.84 | 2.44 | 0.005 | 0.0008 | 0.0032 | 0.042 | 0.030 | 0.014 | 0.0016 | | Inventive steel |
| 1-C | 0.05 | 0.92 | 2.81 | 0.007 | 0.0020 | 0.0029 | 0.032 | 0.024 | 0.032 | 0.0020 | Sb: 0.015, Sn: 0.009 | Inventive steel |
| 1-D | 0.06 | 0.21 | 3.12 | 0.011 | 0.0013 | 0.0033 | 0.028 | 0.024 | 0.012 | 0.0015 | REM: 0.0007 | Inventive steel |
| 1-E | 0.09 | 0.66 | 2.23 | 0.008 | 0.0009 | 0.0023 | 0.046 | 0.012 | 0.017 | 0.0035 | Mo: 0.04 | Inventive steel |
| 1-F | 0.08 | 0.59 | 3.20 | 0.020 | 0.0008 | 0.0040 | 0.038 | 0.022 | 0.017 | 0.0015 | | Inventive steel |
| 1-G | 0.08 | 0.91 | 2.64 | 0.020 | 0.0012 | 0.0036 | 0.970 | 0.015 | 0.019 | 0.0012 | Cu: 0.05 | Inventive steel |
| 1-H | 0.07 | 0.46 | 2.26 | 0.010 | 0.0022 | 0.0042 | 0.050 | 0.020 | 0.025 | 0.0020 | Ni: 0.02 | Inventive steel |
| 1-I | 0.09 | 0.87 | 2.66 | 0.007 | 0.0012 | 0.0031 | 0.031 | 0.022 | 0.010 | 0.0022 | Ca: 0.0012, Mg: 0.0010 | Inventive steel |
| 1-J | 0.08 | 0.74 | 2.34 | 0.001 | 0.0009 | 0.0031 | 0.032 | 0.027 | 0.025 | 0.0014 | V: 0.022 | Inventive steel |
| 1-K | 0.07 | 0.49 | 2.90 | 0.012 | 0.0011 | 0.0021 | 0.025 | 0.013 | 0.022 | 0.0010 | | Inventive steel |
| 1-L | 0.07 | 0.71 | 3.15 | 0.014 | 0.0015 | 0.0044 | 0.045 | 0.030 | 0.024 | 0.0009 | Cr: 0.10 | Inventive steel |
| 1-M | 0.09 | 1.10 | 2.45 | 0.009 | 0.0015 | 0.0025 | 0.027 | 0.017 | 0.016 | 0.0013 | | Inventive steel |
| 1-N | 0.02 | 1.05 | 2.33 | 0.009 | 0.0013 | 0.0028 | 0.030 | 0.023 | 0.028 | 0.0019 | | Comparative steel |
| 1-O | 0.17 | 0.80 | 2.65 | 0.008 | 0.0010 | 0.0025 | 0.030 | 0.022 | 0.015 | 0.0012 | | Comparative steel |
| 1-P | 0.08 | 0.07 | 2.75 | 0.013 | 0.0015 | 0.0028 | 0.033 | 0.037 | 0.027 | 0.0025 | | Comparative steel |
| 1-Q | 0.07 | 1.55 | 2.68 | 0.007 | 0.0016 | 0.0025 | 0.027 | 0.009 | 0.059 | 0.0022 | | Comparative steel |
| 1-R | 0.08 | 0.62 | 1.42 | 0.008 | 0.0009 | 0.0040 | 0.040 | 0.028 | 0.022 | 0.0018 | | Comparative steel |
| 1-S | 0.09 | 0.75 | 3.79 | 0.007 | 0.0015 | 0.0035 | 0.041 | 0.015 | 0.028 | 0.0018 | | Comparative steel |
| 1-T | 0.07 | 0.85 | 2.26 | 0.021 | 0.0010 | 0.0031 | 0.030 | 0.091 | 0.028 | 0.0021 | | Comparative steel |
| 1-U | 0.06 | 0.63 | 2.50 | 0.012 | 0.0020 | 0.0031 | 0.040 | 0.022 | 0.083 | 0.0017 | | Comparative steel |
| 1-V | 0.08 | 0.94 | 2.38 | 0.015 | 0.0011 | 0.0038 | 0.053 | 0.013 | 0.020 | 0.0064 | | Comparative steel |

TABLE 1-2

| Steel type | Component composition (mass %) C | Si | Mn | P | S | N | Al | Ti | Nb | B | Other component | Remarks |
|---|---|---|---|---|---|---|---|---|---|---|---|---|
| 2-A | 0.12 | 0.74 | 2.16 | 0.021 | 0.0011 | 0.0031 | 0.032 | 0.015 | 0.028 | 0.0020 | Cr: 0.09 | Inventive steel |
| 2-B | 0.14 | 0.94 | 2.78 | 0.007 | 0.0009 | 0.0021 | 0.040 | 0.022 | 0.017 | 0.0017 | Mo: 0.03 | Inventive steel |
| 2-C | 0.11 | 0.91 | 2.25 | 0.007 | 0.0015 | 0.0033 | 0.030 | 0.024 | 0.022 | 0.0012 | | Inventive steel |
| 2-D | 0.14 | 0.46 | 2.30 | 0.009 | 0.0015 | 0.0023 | 0.030 | 0.027 | 0.019 | 0.0013 | V: 0.015 | Inventive steel |
| 2-E | 0.15 | 0.57 | 2.67 | 0.020 | 0.0009 | 0.0040 | 0.040 | 0.024 | 0.024 | 0.0018 | | Inventive steel |
| 2-F | 0.13 | 0.82 | 2.15 | 0.007 | 0.0013 | 0.0031 | 0.045 | 0.015 | 0.059 | 0.0016 | | Inventive steel |
| 2-G | 0.12 | 1.13 | 2.68 | 0.012 | 0.0020 | 0.0034 | 0.032 | 0.022 | 0.025 | 0.0018 | Sb: 0.010, Sn: 0.007 | Inventive steel |
| 2-H | 0.14 | 0.84 | 2.43 | 0.001 | 0.0010 | 0.0038 | 0.031 | 0.013 | 0.017 | 0.0005 | Ca: 0.0009, Mg: 0.0015 | Inventive steel |
| 2-I | 0.11 | 0.93 | 2.85 | 0.020 | 0.0011 | 0.0031 | 0.041 | 0.028 | 0.016 | 0.0020 | Ni: 0.04 | Inventive steel |
| 2-J | 0.12 | 0.75 | 2.54 | 0.007 | 0.0008 | 0.0036 | 0.030 | 0.030 | 0.014 | 0.0035 | | Inventive steel |
| 2-K | 0.13 | 0.68 | 2.71 | 0.015 | 0.0008 | 0.0025 | 0.025 | 0.017 | 0.022 | 0.0019 | Cu: 0.08 | Inventive steel |
| 2-L | 0.15 | 0.82 | 2.64 | 0.011 | 0.0022 | 0.0042 | 0.038 | 0.037 | 0.010 | 0.0015 | | Inventive steel |
| 2-M | 0.14 | 0.91 | 2.48 | 0.008 | 0.0012 | 0.0029 | 0.033 | 0.023 | 0.032 | 0.0022 | REM: 0.0010 | Inventive steel |
| 2-N | 0.03 | 1.05 | 2.64 | 0.005 | 0.0015 | 0.0044 | 0.027 | 0.022 | 0.025 | 0.0012 | | Comparative steel |
| 2-O | 0.19 | 0.79 | 2.43 | 0.008 | 0.0014 | 0.0025 | 0.050 | 0.012 | 0.024 | 0.0021 | | Comparative steel |
| 2-P | 0.13 | 0.08 | 2.25 | 0.008 | 0.0013 | 0.0040 | 0.028 | 0.030 | 0.015 | 0.0009 | | Comparative steel |
| 2-Q | 0.11 | 1.64 | 2.47 | 0.009 | 0.0020 | 0.0028 | 0.033 | 0.020 | 0.028 | 0.0015 | | Comparative steel |
| 2-R | 0.14 | 0.84 | 1.55 | 0.012 | 0.0010 | 0.0035 | 0.046 | 0.015 | 0.012 | 0.0010 | | Comparative steel |
| 2-S | 0.12 | 0.79 | 3.52 | 0.007 | 0.0015 | 0.0031 | 0.970 | 0.009 | 0.027 | 0.0014 | | Comparative steel |
| 2-T | 0.16 | 0.58 | 2.65 | 0.014 | 0.0012 | 0.0025 | 0.042 | 0.086 | 0.028 | 0.0022 | | Comparative steel |
| 2-U | 0.15 | 0.76 | 2.76 | 0.010 | 0.0009 | 0.0028 | 0.053 | 0.014 | 0.094 | 0.0025 | | Comparative steel |
| 2-V | 0.14 | 0.96 | 2.24 | 0.013 | 0.0016 | 0.0032 | 0.027 | 0.010 | 0.020 | 0.0075 | | Comparative steel |

TABLE 2-1a

| | | Hot rolling step | | | | | | | Cold rolling step | | Annealing step | |
|---|---|---|---|---|---|---|---|---|---|---|---|---|
| No. | Steel type | Heat rolling starting temp. (° C.) | Finish rolling temp. (° C.) | Rolling reduction (%) | Average cooling rate * 1 (° C./s) | Cooling stop temp. (° C.) | Coiling temp. (° C.) | Hot rolled sheet thickness (mm) | Cold rolled sheet thickness (mm) | Cold rolling rate (%) | Annealing temp. (° C.) | Retaining time at annealing temp. (s) |
| 1-1 | 1-A | 1150 | 850 | 40 | 25 | 450 | 430 | 2.8 | 1.2 | 57 | 820 | 140 |
| 1-2 | 1-B | 1100 | 920 | 50 | 30 | 420 | 390 | 3.0 | 1.8 | 40 | 780 | 280 |
| 1-3 | 1-C | 1050 | 820 | 45 | 35 | 470 | 430 | 2.8 | 1.2 | 57 | 860 | 200 |
| 1-4 | 1-D | 1200 | 900 | 50 | 30 | 500 | 420 | 3.0 | 1.4 | 53 | 870 | 250 |
| 1-5 | 1-E | 1220 | 870 | 50 | 30 | 430 | 430 | 2.2 | 1.4 | 36 | 850 | 80 |
| 1-6 | 1-F | 1150 | 980 | 55 | 25 | 410 | 400 | 3.0 | 1.6 | 47 | 860 | 180 |
| 1-7 | 1-G | 1120 | 960 | 60 | 40 | 450 | 420 | 3.0 | 1.4 | 53 | 820 | 150 |
| 1-8 | 1-H | 1030 | 880 | 40 | 50 | 460 | 450 | 2.4 | 1.2 | 50 | 800 | 60 |
| 1-9 | 1-I | 1160 | 830 | 55 | 45 | 450 | 390 | 3.2 | 1.2 | 63 | 880 | 150 |
| 1-10 | 1-J | 1240 | 900 | 40 | 50 | 420 | 380 | 2.8 | 1.4 | 50 | 770 | 200 |
| 1-11 | 1-K | 1240 | 970 | 50 | 25 | 490 | 400 | 3.2 | 1.6 | 50 | 800 | 250 |
| 1-12 | 1-L | 1110 | 900 | 45 | 45 | 470 | 450 | 3.6 | 2.0 | 44 | 840 | 70 |
| 1-13 | 1-M | 1130 | 930 | 55 | 45 | 440 | 430 | 3.4 | 0.9 | 74 | 860 | 120 |
| 1-14 | 1-N | 1120 | 940 | 50 | 45 | 480 | 460 | 2.8 | 1.6 | 43 | 810 | 300 |
| 1-15 | 1-O | 1270 | 870 | 40 | 40 | 430 | 380 | 2.4 | 0.9 | 63 | 810 | 250 |
| 1-16 | 1-P | 1100 | 880 | 60 | 30 | 460 | 410 | 3.0 | 1.2 | 60 | 850 | 300 |
| 1-17 | 1-Q | 1130 | 880 | 65 | 35 | 490 | 350 | 3.0 | 1.2 | 60 | 860 | 70 |
| 1-18 | 1-R | 1110 | 870 | 55 | 50 | 480 | 430 | 3.4 | 1.4 | 59 | 830 | 100 |
| 1-19 | 1-S | 1230 | 850 | 50 | 40 | 480 | 440 | 2.6 | 1.6 | 38 | 780 | 210 |
| 1-20 | 1-T | 1190 | 900 | 45 | 45 | 460 | 430 | 3.0 | 1.4 | 53 | 850 | 120 |
| 1-21 | 1-U | 1200 | 940 | 65 | 45 | 400 | 390 | 3.6 | 1.2 | 67 | 810 | 70 |
| 1-22 | 1-V | 1250 | 880 | 40 | 50 | 480 | 380 | 2.8 | 1.6 | 43 | 860 | 80 |

| | | Annealing step | | | | | |
|---|---|---|---|---|---|---|---|
| No. | Steel type | Average cooling rate * 2 (° C./s) | Cooling stop temp. (° C.) | Retaining time at cooling stop temp. (s) | Oxidizing step Oxidizing treatment | Pickling step Condition | Remarks |
| 1-1 | 1-A | 20 | 400 | 540 | YES | Condition 3 | Inventive Example |
| 1-2 | 1-B | 15 | 400 | 150 | YES | Condition 3 | Inventive Example |
| 1-3 | 1-C | 25 | 360 | 250 | YES | Condition 3 | Inventive Example |
| 1-4 | 1-D | 25 | 390 | 250 | YES | Condition 3 | Inventive Example |
| 1-5 | 1-E | 20 | 450 | 550 | YES | Condition 3 | Inventive Example |
| 1-6 | 1-F | 20 | 380 | 300 | YES | Condition 3 | Inventive Example |
| 1-7 | 1-G | 25 | 420 | 610 | YES | Condition 3 | Inventive Example |
| 1-8 | 1-H | 15 | 350 | 220 | YES | Condition 3 | Inventive Example |
| 1-9 | 1-I | 15 | 400 | 150 | YES | Condition 3 | Inventive Example |

TABLE 2-1a-continued

| | | | | | | | |
|---|---|---|---|---|---|---|---|
| 1-10 | 1-J | 25 | 380 | 170 | YES | Condition 3 | Inventive Example |
| 1-11 | 1-K | 20 | 430 | 220 | YES | Condition 3 | Inventive Example |
| 1-12 | 1-L | 30 | 360 | 850 | YES | Condition 3 | Inventive Example |
| 1-13 | 1-M | 30 | 370 | 630 | YES | Condition 3 | Inventive Example |
| 1-14 | 1-N | 25 | 430 | 300 | YES | Condition 3 | Comparative Example |
| 1-15 | 1-O | 25 | 360 | 200 | YES | Condition 3 | Comparative Example |
| 1-16 | 1-P | 20 | 350 | 460 | YES | Condition 3 | Comparative Example |
| 1-17 | 1-Q | 20 | 380 | 580 | YES | Condition 3 | Comparative Example |
| 1-18 | 1-R | 25 | 410 | 180 | YES | Condition 3 | Comparative Example |
| 1-19 | 1-S | 20 | 430 | 180 | YES | Condition 3 | Comparative Example |
| 1-20 | 1-T | 30 | 440 | 100 | YES | Condition 3 | Comparative Example |
| 1-21 | 1-U | 15 | 400 | 180 | YES | Condition 3 | Comparative Example |
| 1-22 | 1-V | 25 | 400 | 300 | YES | Condition 3 | Comparative Example |

TABLE 2-1b

| | | Hot rolling step | | | | | | | Cold rolling step | | Annealing step | |
|---|---|---|---|---|---|---|---|---|---|---|---|---|
| No. | Steel type | Heat rolling starting temp. (° C.) | Finish rolling temp. (° C.) | Rolling reduction (%) | Average cooling rate * 1 (° C./s) | Cooling stop temp. (° C.) | Coiling temp. (° C.) | Hot rolled sheet thickness (mm) | Cold rolled sheet thickness (mm) | Cold rolling rate (%) | Annealing temp. (° C.) | Retaining time at annealing temp. (s) |
| 1-23 | 1-A | 1050 | 970 | 15 | 30 | 450 | 430 | 2.2 | 1.4 | 36 | 860 | 180 |
| 1-24 | 1-A | 1150 | 860 | 45 | 35 | 690 | 650 | 3.6 | 1.6 | 56 | 840 | 150 |
| 1-25 | 1-B | 1200 | 940 | 50 | 40 | 430 | 400 | 3.5 | 1.2 | 66 | 700 | 200 |
| 1-26 | 1-B | 1230 | 950 | 45 | 50 | 500 | 400 | 3.2 | 1.6 | 50 | 940 | 230 |
| 1-27 | 1-B | 1220 | 870 | 45 | 40 | 450 | 440 | 3.2 | 1.4 | 56 | 850 | 5 |
| 1-28 | 1-A | 1260 | 900 | 50 | 30 | 490 | 400 | 2.8 | 1.0 | 64 | 840 | 90 |
| 1-29 | 1-A | 1180 | 930 | 50 | 20 | 460 | 450 | 2.4 | 1.2 | 50 | 780 | 200 |
| 1-30 | 1-B | 1150 | 930 | 50 | 40 | 450 | 400 | 3.2 | 1.2 | 63 | 870 | 140 |
| 1-31 | 1-A | 1150 | 850 | 40 | 25 | 450 | 430 | 2.8 | 1.2 | 57 | 820 | 140 |
| 1-32 | 1-A | 1150 | 850 | 40 | 25 | 450 | 430 | 2.8 | 1.2 | 57 | 820 | 140 |
| 1-1 | 1-A | 1150 | 850 | 40 | 25 | 450 | 430 | 2.8 | 1.2 | 57 | 820 | 140 |
| 1-33 | 1-A | 1150 | 850 | 40 | 25 | 450 | 430 | 2.8 | 1.2 | 57 | 820 | 140 |
| 1-34 | 1-A | 1150 | 850 | 40 | 25 | 450 | 430 | 2.8 | 1.2 | 57 | 820 | 140 |
| 1-35 | 1-B | 1100 | 920 | 50 | 30 | 420 | 390 | 3.0 | 1.8 | 40 | 780 | 280 |
| 1-36 | 1-B | 1100 | 920 | 50 | 30 | 420 | 390 | 3.0 | 1.8 | 40 | 780 | 280 |
| 1-2 | 1-B | 1100 | 920 | 50 | 30 | 420 | 390 | 3.0 | 1.8 | 40 | 780 | 280 |
| 1-37 | 1-B | 1100 | 920 | 50 | 30 | 420 | 390 | 3.0 | 1.8 | 40 | 780 | 280 |
| 1-38 | 1-B | 1100 | 920 | 50 | 30 | 420 | 390 | 3.0 | 1.8 | 40 | 780 | 280 |

| | | Annealing step | | | | | |
|---|---|---|---|---|---|---|---|
| No. | Steel type | Average cooling rate * 2 (° C./s) | Cooling stop temp. (° C.) | Retaining time at cooling stop temp. (s) | Oxidizing step Oxidizing treatment | Pickling step Condition | Remarks |
| 1-23 | 1-A | 25 | 430 | 780 | YES | Condition 3 | Comparative Example |
| 1-24 | 1-A | 25 | 400 | 630 | YES | Condition 3 | Comparative Example |
| 1-25 | 1-B | 20 | 380 | 340 | YES | Condition 3 | Comparative Example |
| 1-26 | 1-B | 20 | 420 | 360 | YES | Condition 3 | Comparative Example |
| 1-27 | 1-B | 30 | 410 | 120 | YES | Condition 3 | Comparative Example |
| 1-28 | 1-A | 20 | 180 | 650 | YES | Condition 3 | Comparative Example |
| 1-29 | 1-A | 30 | 490 | 730 | YES | Condition 3 | Comparative Example |
| 1-30 | 1-B | 25 | 400 | 5 | YES | Condition 3 | Comparative Example |
| 1-31 | 1-A | 20 | 400 | 540 | NO | NO | Comparative Example |
| 1-32 | 1-A | 20 | 400 | 540 | YES | Condition 3 | Inventive Example |
| 1-1 | 1-A | 20 | 400 | 540 | YES | Condition 2 | Inventive Example |
| 1-33 | 1-A | 20 | 400 | 540 | YES | Condition 1 | Inventive Example |
| 1-34 | 1-A | 20 | 400 | 540 | YES | NO | Comparative Example |
| 1-35 | 1-B | 15 | 400 | 150 | NO | NO | Comparative Example |
| 1-36 | 1-B | 15 | 400 | 150 | YES | Condition 3 | Inventive Example |
| 1-2 | 1-B | 15 | 400 | 150 | YES | Condition 2 | Inventive Example |
| 1-37 | 1-B | 15 | 400 | 150 | YES | Condition 1 | Inventive Example |
| 1-38 | 1-B | 15 | 400 | 150 | YES | NO | Comparative Example |

TABLE 2-2a

| | | Hot rolling step | | | | | | | Cold rolling step | | Annealing step | |
|---|---|---|---|---|---|---|---|---|---|---|---|---|
| No. | Steel type | Heat rolling starting temp. (° C.) | Finish rolling temp. (° C.) | Rolling reduction (%) | Average cooling rate * 1 (° C./s) | Cooling stop temp. (° C.) | Coiling temp. (° C.) | Hot rolled sheet thickness (mm) | Cold rolled sheet thickness (mm) | Cold rolling rate (%) | Annealing temp. (° C.) | Retaining time at annealing temp. (s) |
| 2-1 | 2-A | 1110 | 950 | 50 | 40 | 500 | 460 | 3.2 | 1.4 | 56 | 820 | 210 |
| 2-2 | 2-B | 1100 | 940 | 45 | 40 | 490 | 480 | 2.8 | 1.6 | 43 | 800 | 120 |
| 2-3 | 2-C | 1200 | 820 | 50 | 30 | 510 | 490 | 2.8 | 1.2 | 57 | 850 | 200 |
| 2-4 | 2-D | 1230 | 850 | 45 | 40 | 460 | 450 | 3.4 | 1.2 | 65 | 830 | 250 |
| 2-5 | 2-E | 1100 | 870 | 50 | 35 | 420 | 410 | 2.8 | 0.9 | 68 | 830 | 60 |
| 2-6 | 2-F | 1240 | 870 | 65 | 40 | 490 | 460 | 3.0 | 1.4 | 53 | 880 | 80 |
| 2-7 | 2-G | 1100 | 900 | 65 | 25 | 590 | 490 | 3.0 | 1.6 | 47 | 860 | 80 |
| 2-8 | 2-H | 1120 | 940 | 40 | 50 | 480 | 450 | 2.8 | 1.4 | 50 | 790 | 70 |
| 2-9 | 2-I | 1220 | 870 | 50 | 35 | 400 | 390 | 3.4 | 1.4 | 59 | 840 | 250 |
| 2-10 | 2-J | 1150 | 900 | 50 | 25 | 430 | 420 | 3.2 | 1.6 | 50 | 790 | 180 |
| 2-11 | 2-K | 1250 | 880 | 50 | 25 | 510 | 450 | 2.8 | 1.4 | 50 | 820 | 200 |
| 2-12 | 2-L | 1150 | 940 | 45 | 35 | 590 | 440 | 3.0 | 1.2 | 60 | 780 | 70 |
| 2-13 | 2-M | 1150 | 970 | 50 | 45 | 500 | 480 | 3.2 | 1.2 | 63 | 860 | 140 |
| 2-14 | 2-N | 1030 | 900 | 40 | 50 | 520 | 450 | 3.0 | 1.4 | 53 | 840 | 70 |
| 2-15 | 2-O | 1180 | 860 | 50 | 40 | 460 | 430 | 3.2 | 1.2 | 63 | 860 | 230 |
| 2-16 | 2-P | 1190 | 870 | 60 | 40 | 500 | 470 | 2.2 | 1.4 | 36 | 870 | 150 |
| 2-17 | 2-Q | 1270 | 860 | 40 | 30 | 480 | 430 | 3.6 | 1.6 | 56 | 860 | 300 |
| 2-18 | 2-R | 1260 | 960 | 40 | 45 | 500 | 450 | 3.5 | 1.4 | 60 | 860 | 150 |
| 2-19 | 2-S | 1150 | 930 | 45 | 50 | 480 | 450 | 3.4 | 2.0 | 41 | 810 | 100 |
| 2-20 | 2-T | 1220 | 880 | 55 | 45 | 580 | 430 | 2.4 | 1.6 | 33 | 870 | 180 |
| 2-21 | 2-U | 1240 | 970 | 45 | 30 | 480 | 460 | 3.2 | 0.9 | 72 | 860 | 150 |
| 2-22 | 2-V | 1170 | 850 | 50 | 45 | 450 | 450 | 2.4 | 1.2 | 50 | 820 | 250 |

| | | Annealing step | | | | | |
|---|---|---|---|---|---|---|---|
| No. | Steel type | Average cooling rate * 2 (° C./s) | Cooling stop temp. (° C.) | Retaining time at cooling stop temp. (s) | Oxidizing step Oxidizing treatment | Pickling step Condition | Remarks |
| 2-1 | 2-A | 25 | 440 | 170 | YES | Condition 3 | Inventive Example |
| 2-2 | 2-B | 15 | 380 | 200 | YES | Condition 3 | Inventive Example |
| 2-3 | 2-C | 20 | 380 | 360 | YES | Condition 3 | Inventive Example |
| 2-4 | 2-D | 15 | 390 | 780 | YES | Condition 3 | Inventive Example |
| 2-5 | 2-E | 25 | 430 | 700 | YES | Condition 3 | Inventive Example |
| 2-6 | 2-F | 25 | 430 | 220 | YES | Condition 3 | Inventive Example |
| 2-7 | 2-G | 25 | 400 | 650 | YES | Condition 3 | Inventive Example |
| 2-8 | 2-H | 20 | 360 | 460 | YES | Condition 3 | Inventive Example |
| 2-9 | 2-I | 25 | 350 | 300 | YES | Condition 3 | Inventive Example |
| 2-10 | 2-J | 25 | 450 | 120 | YES | Condition 3 | Inventive Example |
| 2-11 | 2-K | 15 | 350 | 100 | YES | Condition 3 | Inventive Example |
| 2-12 | 2-L | 20 | 430 | 580 | YES | Condition 3 | Inventive Example |
| 2-13 | 2-M | 25 | 420 | 730 | YES | Condition 3 | Inventive Example |
| 2-14 | 2-N | 20 | 400 | 150 | YES | Condition 3 | Comparative Example |
| 2-15 | 2-O | 25 | 410 | 850 | YES | Condition 3 | Comparative Example |
| 2-16 | 2-P | 30 | 380 | 340 | YES | Condition 3 | Comparative Example |
| 2-17 | 2-Q | 30 | 420 | 250 | YES | Condition 3 | Comparative Example |
| 2-18 | 2-R | 20 | 380 | 180 | YES | Condition 3 | Comparative Example |
| 2-19 | 2-S | 25 | 390 | 150 | YES | Condition 3 | Comparative Example |
| 2-20 | 2-T | 15 | 370 | 180 | YES | Condition 3 | Comparative Example |
| 2-21 | 2-U | 25 | 400 | 250 | YES | Condition 3 | Comparative Example |
| 2-22 | 2-V | 20 | 410 | 220 | YES | Condition 3 | Comparative Example |

TABLE 2-2b

| | | Hot rolling step | | | | | | | Cold rolling step | | Annealing step | |
|---|---|---|---|---|---|---|---|---|---|---|---|---|
| No. | Steel type | Heat rolling starting temp. (° C.) | Finish rolling temp. (° C.) | Rolling reduction (%) | Average cooling rate * 1 (° C./s) | Cooling stop temp. (° C.) | Coiling temp. (° C.) | Hot rolled sheet thickness (mm) | Cold rolled sheet thickness (mm) | Cold rolling rate (%) | Annealing temp. (° C.) | Retaining time at annealing temp. (s) |
| 2-23 | 2-A | 1130 | 880 | 20 | 50 | 440 | 400 | 3.6 | 1.6 | 56 | 850 | 300 |
| 2-24 | 2-A | 1050 | 830 | 40 | 45 | 690 | 640 | 3.2 | 1.0 | 69 | 800 | 200 |
| 2-25 | 2-B | 1050 | 870 | 55 | 30 | 400 | 400 | 3.6 | 1.6 | 56 | 680 | 120 |

TABLE 2-2b-continued

| | | | | | | | | | | | | |
|---|---|---|---|---|---|---|---|---|---|---|---|---|
| 2-26 | 2-B | 1160 | 930 | 40 | 30 | 550 | 500 | 3.0 | 1.2 | 60 | 960 | 100 |
| 2-27 | 2-A | 1130 | 930 | 4 | 30 | 530 | 470 | 2.2 | 1.2 | 45 | 860 | 250 |
| 2-28 | 2-B | 1200 | 900 | 55 | 40 | 550 | 470 | 3.0 | 1.6 | 47 | 810 | 90 |
| 2-29 | 2-A | 1110 | 950 | 50 | 40 | 500 | 460 | 3.2 | 1.4 | 56 | 820 | 210 |
| 2-30 | 2-A | 1110 | 950 | 50 | 40 | 500 | 460 | 3.2 | 1.4 | 56 | 820 | 210 |
| 2-1 | 2-A | 1110 | 950 | 50 | 40 | 500 | 460 | 3.2 | 1.4 | 56 | 820 | 210 |
| 2-31 | 2-A | 1110 | 950 | 50 | 40 | 500 | 460 | 3.2 | 1.4 | 56 | 820 | 210 |
| 2-32 | 2-A | 1110 | 950 | 50 | 40 | 500 | 460 | 3.2 | 1.4 | 56 | 820 | 210 |
| 2-33 | 2-B | 1110 | 940 | 45 | 40 | 490 | 480 | 2.8 | 1.6 | 43 | 800 | 120 |
| 2-34 | 2-B | 1110 | 940 | 45 | 40 | 490 | 480 | 2.8 | 1.6 | 43 | 800 | 120 |
| 2-2 | 2-B | 1110 | 940 | 45 | 40 | 490 | 480 | 2.8 | 1.6 | 43 | 800 | 120 |
| 2-35 | 2-B | 1110 | 940 | 45 | 40 | 490 | 480 | 2.8 | 1.6 | 43 | 800 | 120 |
| 2-36 | 2-B | 1110 | 940 | 45 | 40 | 490 | 480 | 2.8 | 1.6 | 43 | 800 | 120 |

| | | Annealing step | | | | | |
|---|---|---|---|---|---|---|---|
| No. | Steel type | Average cooling rate * 2 (° C./s) | Cooling stop temp. (° C.) | Retaining time at cooling stop temp. (s) | Oxidizing step Oxidizing treatment | Pickling step Condition | Remarks |
| 2-23 | 2-A | 20 | 400 | 630 | YES | Condition 3 | Comparative Example |
| 2-24 | 2-A | 30 | 400 | 300 | YES | Condition 3 | Comparative Example |
| 2-25 | 2-B | 20 | 360 | 180 | YES | Condition 3 | Comparative Example |
| 2-26 | 2-B | 30 | 430 | 300 | YES | Condition 3 | Comparative Example |
| 2-27 | 2-A | 30 | 240 | 540 | YES | Condition 3 | Comparative Example |
| 2-28 | 2-B | 20 | 370 | 5 | YES | Condition 3 | Comparative Example |
| 2-29 | 2-A | 25 | 440 | 170 | NO | NO | Comparative Example |
| 2-30 | 2-A | 25 | 440 | 170 | YES | Condition 3 | Inventive Example |
| 2-1 | 2-A | 25 | 440 | 170 | YES | Condition 2 | Inventive Example |
| 2-31 | 2-A | 25 | 440 | 170 | YES | Condition 1 | Inventive Example |
| 2-32 | 2-A | 25 | 440 | 170 | YES | NO | Comparative Example |
| 2-33 | 2-B | 15 | 380 | 200 | NO | NO | Comparative Example |
| 2-34 | 2-B | 15 | 380 | 200 | YES | Condition 3 | Inventive Example |
| 2-2 | 2-B | 15 | 380 | 200 | YES | Condition 2 | Inventive Example |
| 2-35 | 2-B | 15 | 380 | 200 | YES | Condition 1 | Inventive Example |
| 2-36 | 2-B | 15 | 380 | 200 | YES | NO | Comparative Example |

TABLE 3-1a

| | | Ferrite | | Retained austenite | | Bainite | | Martensite | | Concentration ratio | |
|---|---|---|---|---|---|---|---|---|---|---|---|
| No. | Steel type | Volume fraction (%) | Average grain size (μm) | Volume fraction (%) | Average grain size (μm) | Volume fraction (%) | Average grain size (μm) | Volume fraction (%) | Average grain size (μm) | Si mass ratio | Mn mass ration |
| 1-1 | 1-A | 35 | 4.2 | 4 | 1.8 | 24 | 4.8 | 36 | 3.1 | 1.10 | 1.10 |
| 1-2 | 1-B | 52 | 4.5 | 2 | 0.6 | 15 | 5.0 | 28 | 2.8 | 1.10 | 0.11 |
| 1-3 | 1-C | 36 | 5.1 | 4 | 1.2 | 32 | 4.8 | 19 | 2.4 | 1.14 | 1.10 |
| 1-4 | 1-D | 32 | 3.4 | 6 | 0.7 | 27 | 4.2 | 34 | 3.3 | 1.10 | 1.12 |
| 1-5 | 1-E | 44 | 4.8 | 2 | 0.4 | 17 | 3.5 | 34 | 3.4 | 1.14 | 1.14 |
| 1-6 | 1-F | 55 | 5.7 | 2 | 0.4 | 24 | 3.0 | 17 | 2.6 | 1.11 | 1.15 |
| 1-7 | 1-G | 40 | 4.2 | 4 | 0.8 | 33 | 2.9 | 21 | 2.2 | 1.14 | 1.12 |
| 1-8 | 1-H | 53 | 4.0 | 2 | 0.7 | 25 | 4.3 | 16 | 3.0 | 1.14 | 1.15 |
| 1-9 | 1-I | 25 | 3.3 | 4 | 1.2 | 35 | 3.9 | 23 | 2.8 | 1.14 | 1.10 |
| 1-10 | 1-J | 53 | 5.1 | 1 | 0.4 | 35 | 4.8 | 8 | 3.0 | 1.15 | 1.12 |
| 1-11 | 1-K | 42 | 4.2 | 3 | 0.9 | 26 | 3.7 | 19 | 2.4 | 1.14 | 1.14 |
| 1-12 | 1-L | 33 | 3.9 | 2 | 1.4 | 30 | 4.3 | 21 | 2.8 | 1.15 | 1.15 |
| 1-13 | 1-M | 32 | 3.5 | 3 | 0.6 | 27 | 3.8 | 26 | 3.0 | 1.13 | 1.12 |
| 1-14 | 1-N | 52 | 4.6 | 0 | 0.0 | 38 | 4.2 | 1 | 1.2 | 1.13 | 1.15 |
| 1-15 | 1-O | 12 | 3.5 | 12 | 1.4 | 12 | 3.8 | 51 | 3.4 | 1.12 | 1.14 |
| 1-16 | 1-P | 39 | 3.7 | 0 | 0.0 | 34 | 4.0 | 19 | 3.0 | 1.15 | 1.14 |
| 1-17 | 1-Q | 34 | 4.6 | 8 | 1.2 | 28 | 4.5 | 18 | 3.5 | 1.13 | 1.13 |
| 1-18 | 1-R | 51 | 4.5 | 0 | 0.0 | 22 | 4.2 | 14 | 2.1 | 1.12 | 1.13 |
| 1-19 | 1-S | 13 | 3.8 | 12 | 1.5 | 18 | 3.8 | 51 | 2.6 | 1.12 | 1.15 |
| 1-20 | 1-T | 40 | 4.8 | 3 | 0.5 | 24 | 4.6 | 19 | 3.7 | 1.13 | 1.14 |
| 1-21 | 1-U | 37 | 3.3 | 4 | 0.6 | 34 | 3.6 | 18 | 2.9 | 1.13 | 1.14 |
| 1-22 | 1-V | 19 | 4.8 | 2 | 0.4 | 15 | 4.5 | 51 | 3.4 | 1.13 | 1.14 |

TABLE 3-1a-continued

| No. | Steel type | Mechanical properties TS (MPa) | El (%) | λ (%) | Welding test | Type of steel sheet | Remarks |
|---|---|---|---|---|---|---|---|
| 1-1 | 1-A | 1055 | 17.2 | 42 | Good | CR | Inventive Example |
| 1-2 | 1-B | 1025 | 17.8 | 48 | Good | GA | Inventive Example |
| 1-3 | 1-C | 998 | 16.9 | 46 | Good | GA | Inventive Example |
| 1-4 | 1-D | 1042 | 16.0 | 38 | Good | GA | Inventive Example |
| 1-5 | 1-E | 1023 | 16.7 | 50 | Good | CR | Inventive Example |
| 1-6 | 1-F | 987 | 18.2 | 59 | Good | GA | Inventive Example |
| 1-7 | 1-G | 1009 | 17.8 | 58 | Good | CR | Inventive Example |
| 1-8 | 1-H | 990 | 18.3 | 48 | Good | GA | Inventive Example |
| 1-9 | 1-I | 1016 | 15.8 | 42 | Good | GA | Inventive Example |
| 1-10 | 1-J | 990 | 17.6 | 54 | Good | GA | Inventive Example |
| 1-11 | 1-K | 1045 | 16.3 | 46 | Good | CR | Inventive Example |
| 1-12 | 1-L | 1047 | 15.7 | 36 | Good | GA | Inventive Example |
| 1-13 | 1-M | 1030 | 16.0 | 43 | Good | EG | Inventive Example |
| 1-14 | 1-N | 925 | 20.6 | 77 | Good | GI | Comparative Example |
| 1-15 | 1-O | 1126 | 8.5 | 20 | Poor | CR | Comparative Example |
| 1-16 | 1-P | 995 | 9.5 | 48 | Good | GA | Comparative Example |
| 1-17 | 1-Q | 1074 | 18.9 | 44 | Poor | GI | Comparative Example |
| 1-18 | 1-R | 1013 | 12.5 | 43 | Good | EG | Comparative Example |
| 1-19 | 1-S | 1156 | 16.7 | 24 | Poor | GA | Comparative Example |
| 1-20 | 1-T | 1015 | 9.3 | 42 | Good | CR | Comparative Example |
| 1-21 | 1-U | 1108 | 8.4 | 46 | Good | GA | Comparative Example |
| 1-22 | 1-V | 1167 | 7.5 | 24 | Good | CR | Comparative Example |

TABLE 3-1b

| No. | Steel type | Ferrite Volume fraction (%) | Ferrite Average grain size (μm) | Retained austenite Volume fraction (%) | Retained austenite Average grain size (μm) | Bainite Volume fraction (%) | Bainite Average grain size (μm) | Martensite Volume fraction (%) | Martensite Average grain size (μm) | Concentration ratio Si mass ratio | Concentration ratio Mn mass ration |
|---|---|---|---|---|---|---|---|---|---|---|---|
| 1-23 | 1-A | 35 | 7.2 | 3 | 0.3 | 26 | 6.8 | 21 | 4.4 | 1.11 | 1.14 |
| 1-24 | 1-A | 37 | 6.4 | 3 | 0.3 | 24 | 6.5 | 18 | 4.6 | 1.12 | 1.12 |
| 1-25 | 1-B | 74 | 5.8 | 4 | 0.6 | 8 | 3.0 | 7 | 2.3 | 1.12 | 1.14 |
| 1-26 | 1-B | 15 | 6.6 | 2 | 4.5 | 28 | 6.8 | 20 | 5.2 | 1.11 | 1.13 |
| 1-27 | 1-B | 74 | 3.2 | 1 | 0.5 | 10 | 2.9 | 10 | 2.8 | 1.12 | 1.13 |
| 1-28 | 1-A | 19 | 3.8 | 4 | 0.8 | 12 | 3.4 | 56 | 3.8 | 1.13 | 1.14 |
| 1-29 | 1-A | 15 | 4.2 | 6 | 1.2 | 67 | 4.4 | 1 | 1.7 | 1.11 | 1.13 |
| 1-30 | 1-B | 20 | 3.4 | 1 | 0.6 | 8 | 3.1 | 54 | 3.7 | 1.12 | 1.13 |
| 1-31 | 1-A | 35 | 4.2 | 4 | 1.8 | 24 | 4.8 | 36 | 3.1 | 1.00 | 1.00 |
| 1-32 | 1-A | 35 | 4.2 | 4 | 1.8 | 24 | 4.8 | 36 | 3.1 | 1.07 | 1.07 |
| 1-1 | 1-A | 35 | 4.2 | 4 | 1.8 | 24 | 4.8 | 36 | 3.1 | 1.12 | 1.12 |
| 1-33 | 1-A | 35 | 4.2 | 4 | 1.8 | 24 | 4.8 | 36 | 3.1 | 1.25 | 1.25 |
| 1-34 | 1-A | 35 | 4.2 | 4 | 1.8 | 24 | 4.8 | 36 | 3.1 | 1.30 | 1.30 |
| 1-35 | 1-B | 52 | 4.5 | 2 | 0.6 | 15 | 5.0 | 28 | 2.8 | 1.00 | 1.00 |
| 1-36 | 1-B | 52 | 4.5 | 2 | 0.6 | 15 | 5.0 | 28 | 2.8 | 1.07 | 1.07 |
| 1-2 | 1-B | 52 | 4.5 | 2 | 0.6 | 15 | 5.0 | 28 | 2.8 | 1.12 | 1.12 |
| 1-37 | 1-B | 52 | 4.5 | 2 | 0.6 | 15 | 5.0 | 28 | 2.8 | 1.25 | 1.25 |
| 1-38 | 1-B | 52 | 4.5 | 2 | 0.6 | 15 | 5.0 | 28 | 2.8 | 1.30 | 1.30 |

| No. | Steel type | Mechanical properties TS (MPa) | El (%) | λ (%) | Welding test | Type of steel sheet | Remarks |
|---|---|---|---|---|---|---|---|
| 1-23 | 1-A | 1055 | 16.8 | 22 | Good | GI | Comparative Example |
| 1-24 | 1-A | 1055 | 16.8 | 25 | Good | GI | Comparative Example |
| 1-25 | 1-B | 997 | 19.4 | 20 | Good | GA | Comparative Example |
| 1-26 | 1-B | 1075 | 15.9 | 23 | Good | CR | Comparative Example |
| 1-27 | 1-B | 964 | 19.3 | 62 | Good | CR | Comparative Example |
| 1-28 | 1-A | 1164 | 11.4 | 43 | Good | CR | Comparative Example |
| 1-29 | 1-A | 965 | 17.0 | 36 | Good | GI | Comparative Example |
| 1-30 | 1-B | 1164 | 14.2 | 40 | Good | CR | Comparative Example |
| 1-31 | 1-A | 1055 | 17.2 | 34 | Good | CR | Comparative Example |
| 1-32 | 1-A | 1055 | 17.2 | 36 | Good | CR | Inventive Example |
| 1-1 | 1-A | 1055 | 17.2 | 42 | Good | CR | Inventive Example |
| 1-33 | 1-A | 1055 | 17.2 | 39 | Fair | CR | Inventive Example |
| 1-34 | 1-A | 1055 | 17.2 | 35 | Poor | CR | Comparative Example |

TABLE 3-1b-continued

| | | | | | | | |
|---|---|---|---|---|---|---|---|
| 1-35 | 1-B | 1025 | 17.8 | 34 | Good | GA | Comparative Example |
| 1-36 | 1-B | 1025 | 17.8 | 38 | Good | GA | Inventive Example |
| 1-2 | 1-B | 1025 | 17.8 | 48 | Good | GA | Inventive Example |
| 1-37 | 1-B | 1025 | 17.8 | 42 | Fair | GA | Inventive Example |
| 1-38 | 1-B | 1025 | 17.8 | 35 | Poor | GA | Comparative Example |

TABLE 3-2a

| | | Ferrite | | Retained austenite | | Bainite | | Martensite | | Concentration ratio | |
|---|---|---|---|---|---|---|---|---|---|---|---|
| No. | Steel type | Volume fraction (%) | Average grain size (μm) | Volume fraction (%) | Average grain size (μm) | Volume fraction (%) | Average grain size (μm) | Volume fraction (%) | Average grain size (μm) | Si mass ratio | Mn mass ration |
| 2-1 | 2-A | 25 | 3.4 | 2 | 0.5 | 43 | 3.6 | 18 | 2.0 | 1.15 | 1.14 |
| 2-2 | 2-B | 24 | 2.8 | 2 | 0.6 | 40 | 2.6 | 24 | 2.4 | 1.13 | 1.13 |
| 2-3 | 2-C | 25 | 2.9 | 3 | 1.0 | 45 | 3.2 | 16 | 2.9 | 1.10 | 1.14 |
| 2-4 | 2-D | 19 | 3.4 | 5 | 0.8 | 48 | 3.5 | 15 | 2.4 | 1.15 | 1.12 |
| 2-5 | 2-E | 22 | 3.1 | 3 | 0.5 | 51 | 3.4 | 12 | 2.7 | 1.13 | 1.13 |
| 2-6 | 2-F | 25 | 3.7 | 2 | 0.6 | 36 | 3.5 | 25 | 2.8 | 1.10 | 1.15 |
| 2-7 | 2-G | 24 | 3.7 | 1 | 0.4 | 35 | 3.8 | 26 | 2.8 | 1.12 | 1.13 |
| 2-8 | 2-H | 20 | 2.5 | 2 | 0.6 | 30 | 2.4 | 35 | 2.1 | 1.12 | 1.12 |
| 2-9 | 2-I | 16 | 3.2 | 3 | 0.8 | 41 | 3.0 | 26 | 2.6 | 1.13 | 1.13 |
| 2-10 | 2-J | 25 | 2.5 | 5 | 1.1 | 25 | 2.8 | 34 | 2.1 | 1.10 | 1.12 |
| 2-11 | 2-K | 20 | 2.8 | 3 | 0.7 | 42 | 3.2 | 20 | 1.8 | 1.11 | 1.14 |
| 2-12 | 2-L | 23 | 2.6 | 6 | 1.2 | 24 | 2.4 | 38 | 2.9 | 1.14 | 1.15 |
| 2-13 | 2-M | 15 | 3.7 | 3 | 0.4 | 44 | 3.2 | 23 | 2.5 | 1.12 | 1.14 |
| 2-14 | 2-N | 29 | 3.1 | 0 | 0.0 | 53 | 2.7 | 1 | 1.3 | 1.13 | 1.14 |
| 2-15 | 2-O | 12 | 3.4 | 13 | 1.8 | 21 | 3.0 | 54 | 2.8 | 1.11 | 1.14 |
| 2-16 | 2-P | 28 | 2.7 | 0 | 0.0 | 43 | 2.4 | 18 | 2.6 | 1.13 | 1.14 |
| 2-17 | 2-Q | 29 | 3.3 | 10 | 1.5 | 37 | 3.0 | 15 | 2.7 | 1.13 | 1.11 |
| 2-18 | 2-R | 21 | 2.8 | 0 | 0.0 | 42 | 3.2 | 21 | 2.0 | 1.11 | 1.10 |
| 2-19 | 2-S | 12 | 2.4 | 12 | 1.6 | 22 | 2.6 | 54 | 3.0 | 1.12 | 1.14 |
| 2-20 | 2-T | 21 | 3.6 | 4 | 0.9 | 28 | 3.0 | 36 | 2.7 | 1.10 | 1.14 |
| 2-21 | 2-U | 16 | 2.4 | 2 | 0.6 | 42 | 2.9 | 27 | 2.6 | 1.12 | 1.14 |
| 2-22 | 2-V | 22 | 3.6 | 3 | 0.9 | 22 | 3.2 | 53 | 2.8 | 1.12 | 1.15 |

| | | Mechanical properties | | | | Type of | |
|---|---|---|---|---|---|---|---|
| No. | Steel type | TS (MPa) | El (%) | λ (%) | Welding test | steel sheet | Remarks |
| 2-1 | 2-A | 1197 | 14.5 | 41 | Good | GA | Inventive Example |
| 2-2 | 2-B | 1206 | 14.3 | 38 | Good | CR | Inventive Example |
| 2-3 | 2-C | 1187 | 15.1 | 46 | Good | CR | Inventive Example |
| 2-4 | 2-D | 1230 | 13.7 | 49 | Good | GA | Inventive Example |
| 2-5 | 2-E | 1207 | 14.3 | 44 | Good | GA | Inventive Example |
| 2-6 | 2-F | 1193 | 15.0 | 35 | Good | CR | Inventive Example |
| 2-7 | 2-G | 1201 | 15.4 | 42 | Good | GA | Inventive Example |
| 2-8 | 2-H | 1213 | 13.3 | 38 | Good | CR | Inventive Example |
| 2-9 | 2-I | 1202 | 14.5 | 48 | Good | GI | Inventive Example |
| 2-10 | 2-J | 1196 | 14.6 | 40 | Good | GA | Inventive Example |
| 2-11 | 2-K | 1204 | 13.8 | 54 | Good | CR | Inventive Example |
| 2-12 | 2-L | 1235 | 12.5 | 42 | Good | GA | Inventive Example |
| 2-13 | 2-M | 1216 | 14.6 | 58 | Good | GA | Inventive Example |
| 2-14 | 2-N | 975 | 20.5 | 66 | Good | GI | Comparative Example |
| 2-15 | 2-O | 1285 | 7.8 | 24 | Poor | GI | Comparative Example |
| 2-16 | 2-P | 1204 | 10.3 | 46 | Good | GA | Comparative Example |
| 2-17 | 2-Q | 1215 | 13.7 | 43 | Poor | CR | Comparative Example |
| 2-18 | 2-R | 1194 | 10.6 | 54 | Good | GA | Comparative Example |
| 2-19 | 2-S | 1256 | 14.1 | 29 | Poor | GA | Comparative Example |
| 2-20 | 2-T | 1202 | 9.8 | 36 | Good | CR | Comparative Example |
| 2-21 | 2-U | 1215 | 9.1 | 43 | Good | GI | Comparative Example |
| 2-22 | 2-V | 1254 | 8.0 | 22 | Good | CR | Comparative Example |

TABLE 3-2b

| No. | Steel type | Ferrite Volume fraction (%) | Ferrite Average grain size (μm) | Retained austenite Volume fraction (%) | Retained austenite Average grain size (μm) | Bainite Volume fraction (%) | Bainite Average grain size (μm) | Martensite Volume fraction (%) | Martensite Average grain size (μm) | Concentration ratio Si mass ratio | Concentration ratio Mn mass ration |
|---|---|---|---|---|---|---|---|---|---|---|---|
| 2-23 | 2-A | 20 | 6.9 | 2 | 0.4 | 36 | 7.1 | 38 | 4.6 | 1.13 | 1.13 |
| 2-24 | 2-A | 25 | 7.1 | 3 | 1.1 | 40 | 8.4 | 26 | 4.1 | 1.12 | 1.14 |
| 2-25 | 2-B | 72 | 3.4 | 5 | 1.3 | 13 | 3.0 | 10 | 2.3 | 1.12 | 1.14 |
| 2-26 | 2-B | 19 | 6.4 | 4 | 5.2 | 34 | 7.9 | 34 | 5.2 | 1.13 | 1.13 |
| 2-27 | 2-A | 16 | 2.8 | 6 | 0.6 | 22 | 2.6 | 56 | 2.7 | 1.13 | 1.14 |
| 2-28 | 2-B | 19 | 3.4 | 5 | 0.6 | 8 | 3.0 | 58 | 2.8 | 1.12 | 1.14 |
| 2-29 | 2-A | 25 | 3.4 | 2 | 0.5 | 43 | 3.6 | 18 | 2.0 | 1.00 | 1.00 |
| 2-30 | 2-A | 25 | 3.4 | 2 | 0.5 | 43 | 3.6 | 18 | 2.0 | 1.07 | 1.07 |
| 2-1 | 2-A | 25 | 3.4 | 2 | 0.5 | 43 | 3.6 | 18 | 2.0 | 1.12 | 1.12 |
| 2-31 | 2-A | 25 | 3.4 | 2 | 0.5 | 43 | 3.6 | 18 | 2.0 | 1.25 | 1.25 |
| 2-32 | 2-A | 25 | 3.4 | 2 | 0.5 | 43 | 3.6 | 18 | 2.0 | 1.30 | 1.30 |
| 2-33 | 2-B | 24 | 2.8 | 2 | 0.6 | 40 | 2.6 | 24 | 2.4 | 1.00 | 1.00 |
| 2-34 | 2-B | 24 | 2.8 | 2 | 0.6 | 40 | 2.6 | 24 | 2.4 | 1.07 | 1.07 |
| 2-2 | 2-B | 24 | 2.8 | 2 | 0.6 | 40 | 2.6 | 24 | 2.4 | 1.12 | 1.12 |
| 2-35 | 2-B | 24 | 2.8 | 2 | 0.6 | 40 | 2.6 | 24 | 2.4 | 1.25 | 1.25 |
| 2-36 | 2-B | 24 | 2.8 | 2 | 0.6 | 40 | 2.6 | 24 | 2.4 | 1.30 | 1.30 |

| No. | Steel type | Mechanical properties TS (MPa) | El (%) | λ (%) | Welding test | Type of steel sheet | Remarks |
|---|---|---|---|---|---|---|---|
| 2-23 | 2-A | 1220 | 13.1 | 20 | Good | GA | Comparative Example |
| 2-24 | 2-A | 1214 | 13.6 | 22 | Good | CR | Comparative Example |
| 2-25 | 2-B | 1080 | 17.5 | 18 | Good | GA | Comparative Example |
| 2-26 | 2-B | 1230 | 12.8 | 19 | Good | GI | Comparative Example |
| 2-27 | 2-A | 1260 | 9.7 | 22 | Good | EG | Comparative Example |
| 2-28 | 2-B | 1230 | 9.4 | 22 | Good | GA | Comparative Example |
| 2-29 | 2-A | 1197 | 14.5 | 34 | Good | GA | Comparative Example |
| 2-30 | 2-A | 1197 | 14.5 | 36 | Good | GA | Inventive Example |
| 2-1 | 2-A | 1197 | 14.5 | 41 | Good | GA | Inventive Example |
| 2-31 | 2-A | 1197 | 14.5 | 38 | Fair | GA | Inventive Example |
| 2-32 | 2-A | 1197 | 14.5 | 35 | Poor | GA | Comparative Example |
| 2-33 | 2-B | 1206 | 14.3 | 34 | Good | CR | Comparative Example |
| 2-34 | 2-B | 1206 | 14.3 | 36 | Good | CR | Inventive Example |
| 2-2 | 2-B | 1206 | 14.3 | 38 | Good | CR | Inventive Example |
| 2-35 | 2-B | 1206 | 14.3 | 37 | Fair | CR | Inventive Example |
| 2-36 | 2-B | 1206 | 14.3 | 35 | Poor | CR | Comparative Example |

In Tables 1, 2 and 3 above, the underlined are those deviating from the ranges according to aspects of the invention.

"Average cooling rate *1" refers to an average cooling rate in a temperature range from 700° C. to the cooling stop temperature, while "Average cooling rate *2" refers to an average cooling rate after retention in an annealing temperature range until the cooling stop temperature was reached.

As can be seen from Table 3-1 (980-MPa class), the inventive examples having the specific component composition and the specific steel structure with the Si concentration ratio described above falling in the range of more than 1.00 but less than 1.30 exhibited high strength, and excellent ductility, hole expandability and resistance weldability. Among these, Example Nos. 1-1 to 1-13, 1-32 and 1-36 having the Si concentration ratio of not more than 1.20 showed more excellent resistance weldability.

Comparison of Example No. 1-1 and Nos. 1-32 to 1-33 (similar embodiments having only differences in the Si concentration ratio and the Mn concentration ratio) reveals that Example Nos. 1-1 and 1-33 having the Si concentration ratio of not less than 1.10 exhibited more excellent hole expandability. Among these, Example No. 1-1 having the Si concentration ratio of not more than 1.20 showed further more excellent hole expandability.

Similarly, comparison of Example No. 1-2 and Nos. 1-36 to 2-37 (similar embodiments having only differences in the Si concentration ratio and the Mn concentration ratio) reveals that Example Nos. 1-2 and 1-37 having the Si concentration ratio of not less than 1.10 exhibited more excellent hole expandability. Among these, Example No. 1-2 having the Si concentration ratio of not more than 1.20 exhibited further more excellent hole expandability.

In contrast, at least one of strength, ductility, hole expandability and resistance weldability was insufficient in Example Nos. 1-14 to 1-22 with the component composition deviating from the specific range, Example Nos. 1-23 to 1-30 with the steel structure deviating from the specific range, Example Nos. 1-31 and 1-35 with the Si concentration ratio of not more than 1.00 and Example Nos. 1-34 and 1-38 with Si concentration ratio of not less than 1.30.

As can be seen from Table 3-2 (1180-MPa class), the same tendency as in Table 3-1 (980-MPa class) was seen in the 1180-MPa class.

The invention claimed is:

1. A high strength cold rolled steel sheet, the high strength cold rolled steel sheet having a tensile strength of 980 MPa or more, the high strength cold rolled steel sheet having a composition including: by mass, C in an amount of not less than 0.04% but not more than 0.16%;

Si in an amount of not less than 0.15% but not more than 1.25%;

Mn in an amount of not less than 2.00% but not more than 3.50%;

P in an amount of not more than 0.050%;

S in an amount of not more than 0.0050%;

N in an amount of not more than 0.0100%;

Al in an amount of not less than 0.010% but not more than 2.000%;

Ti in an amount of not less than 0.005% but not more than 0.075%;

Nb in an amount of not less than 0.005% but not more than 0.075%; and

B in an amount of not less than 0.0002% but not more than 0.0040%, with the balance being Fe and inevitable impurities, and a steel structure including: by volume fraction, ferrite of not less than 10% but not more than 70%; retained austenite of not less than 1% but not more than 10%; bainite of not less than 10% but not more than 60%; and martensite of not less than 8% but not more than 50%, wherein the ferrite has an average grain size of not more than 6.0 μm, the retained austenite has an average grain size of not more than 4.0 μm, the bainite has an average grain size of not more than 6.0 μm, and the martensite has an average grain size of not more than 4.0 μm, and wherein a concentration ratio of an average Si concentration in a region extending from a surface up to 10 μm in a depth direction in the high strength cold rolled steel sheet to an average Si concentration in a whole of the high strength cold rolled steel sheet is more than 1.00 but less than 1.30 by mass ratio.

2. The high strength cold rolled steel sheet according to claim 1, further including at least one element selected from the group consisting of: by mass, V in an amount of not less than 0.005% but not more than 0.200%; Cr in an amount of not less than 0.05% but not more than 0.20%; Mo in an amount of not less than 0.01% but not more than 0.20%; Cu in an amount of not less than 0.05% but not more than 0.20%; Ni in an amount of not less than 0.01% but not more than 0.20%; Sb in an amount of not less than 0.002% but not more than 0.100%; Sn in an amount of not less than 0.002% but not more than 0.100%; Ca in an amount of not less than 0.0005% but not more than 0.0050%; Mg in an amount of not less than 0.0005% but not more than 0.0050%; and REM in an amount of not less than 0.0005% but not more than 0.0050%, with the balance being Fe and inevitable impurities.

3. The high strength cold rolled steel sheet according to claim 2, wherein a concentration ratio of an average Mn concentration in a region extending from a surface up to 10 μm in a depth direction in the high strength cold rolled steel sheet to an average Mn concentration in a whole of the high strength cold rolled steel sheet is more than 1.00 but less than 1.30 by mass ratio.

4. The high strength cold rolled steel sheet according to claim 3, wherein the high strength cold rolled steel sheet has one of a galvanizing layer, a galvannealing layer and an electrogalvanizing layer on its surface.

5. The high strength cold rolled steel sheet according to claim 2, wherein the high strength cold rolled steel sheet has one of a galvanizing layer, a galvannealing layer and an electrogalvanizing layer on its surface.

6. The high strength cold rolled steel sheet according to claim 1, wherein a concentration ratio of an average Mn concentration in a region extending from a surface up to 10 μm in a depth direction in the high strength cold rolled steel sheet to an average Mn concentration in a whole of the high strength cold rolled steel sheet is more than 1.00 but less than 1.30 by mass ratio.

7. The high strength cold rolled steel sheet according to claim 6, wherein the high strength cold rolled steel sheet has one of a galvanizing layer, a galvannealing layer and an electrogalvanizing layer on its surface.

8. The high strength cold rolled steel sheet according to claim 1, wherein the high strength cold rolled steel sheet has one of a galvanizing layer, a galvannealing layer and an electrogalvanizing layer on its surface.

9. A method of manufacturing the high strength cold rolled steel sheet according to claim 1, wherein a steel slab having the composition according to claim 1 is subjected to at least one pass of hot rolling at a hot rolling starting temperature of not lower than 1,000° C. but not higher than 1,300° C., a finish rolling temperature of not lower than 800° C. but not higher than 1,000° C. and a rolling reduction of not less than 35%, subsequently cooled in a temperature range from 700° C. to a cooling stop temperature under a condition of an average cooling rate of not lower than 5° C./s but not higher than 50° C./s to reach a cooling stop temperature of not higher than 600° C., then coiled at a coiling temperature of not less than 350° C. but not higher than 600° C., subsequently subjected to pickling and thereafter cold rolling at a cold rolling rate of not less than 30%, in a subsequent annealing step, retained at an annealing temperature of not lower than 750° C. but not higher than 900° C. for not less than 10 seconds but not more than 300 seconds, then cooled at a cooling rate of not less than 5° C./s to reach a cooling stop temperature of not lower than 300° C. but not higher than 450° C. and subsequently retained at the cooling stop temperature for not less than 10 seconds but not more than 1,800 seconds, and thereafter subjected to oxidizing treatment and further pickling.

10. The method according to claim 9, wherein the pickling after the oxidizing treatment is followed by galvanizing treatment, treatment involving galvanizing and alloying, or electrogalvanizing treatment.

11. A method of manufacturing the high strength cold rolled steel sheet according to claim 2, wherein a steel slab having the composition according to claim 2 is subjected to at least one pass of hot rolling at a hot rolling starting temperature of not lower than 1,000° C. but not higher than 1,300° C., a finish rolling temperature of not lower than 800° C. but not higher than 1,000° C. and a rolling reduction of not less than 35%, subsequently cooled in a temperature range from 700° C. to a cooling stop temperature under a condition of an average cooling rate of not lower than 5° C./s but not higher than 50° C./s to reach a cooling stop temperature of not higher than 600° C., then coiled at a coiling temperature of not less than 350° C. but not higher than 600° C., subsequently subjected to pickling and thereafter cold rolling at a cold rolling rate of not less than 30%, in a subsequent annealing step, retained at an annealing temperature of not lower than 750° C. but not higher than 900° C. for not less than 10 seconds but not more than 300 seconds, then cooled at a cooling rate of not less than 5° C./s to reach a cooling stop temperature of not lower than 300° C. but not higher than 450° C. and subsequently retained at the cooling stop temperature for not less than 10 seconds but not more than 1,800 seconds, and thereafter subjected to oxidizing treatment and further pickling.

12. A method of manufacturing the high strength cold rolled steel sheet according to claim 6, wherein a steel slab having the composition according to claim 1 is subjected to at least one pass of hot rolling at a hot rolling starting temperature of not lower than 1,000° C. but not higher than 1,300° C., a finish rolling temperature of not lower than 800° C. but not higher than 1,000° C. and a rolling reduction of not less than 35%, subsequently cooled in a temperature range from 700° C. to a cooling stop temperature under a condition of an average cooling rate of not lower than 5° C./s but not higher than 50° C./s to reach a cooling stop temperature of not higher than 600° C., then coiled at a coiling temperature of not less than 350° C. but not higher than 600° C., subsequently subjected to pickling and thereafter cold rolling at a cold rolling rate of not less than 30%, in a subsequent annealing step, retained at an annealing temperature of not lower than 750° C. but not higher than 900° C. for not less than 10 seconds but not more than 300 seconds, then cooled at a cooling rate of not less than 5° C./s to reach a cooling stop temperature of not lower than 300° C. but not higher than 450° C. and subsequently retained at the cooling stop temperature for not less than 10 seconds but not more than 1,800 seconds, and thereafter subjected to oxidizing treatment and further pickling.

13. A method of manufacturing the high strength cold rolled steel sheet according to claim 7, wherein a steel slab having the composition according to claim 1 is subjected to at least one pass of hot rolling at a hot rolling starting temperature of not lower than 1,000° C. but not higher than 1,300° C., a finish rolling temperature of not lower than 800° C. but not higher than 1,000° C. and a rolling reduction of not less than 35%, subsequently cooled in a temperature range from 700° C. to a cooling stop temperature under a condition of an average cooling rate of not lower than 5° C./s but not higher than 50° C./s to reach a cooling stop temperature of not higher than 600° C., then coiled at a coiling temperature of not less than 350° C. but not higher than 600° C., subsequently subjected to pickling and thereafter cold rolling at a cold rolling rate of not less than 30%, in a subsequent annealing step, retained at an annealing temperature of not lower than 750° C. but not higher than 900° C. for not less than 10 seconds but not more than 300 seconds, then cooled at a cooling rate of not less than 5° C./s to reach a cooling stop temperature of not lower than 300° C. but not higher than 450° C. and subsequently retained at the cooling stop temperature for not less than 10 seconds but not more than 1,800 seconds, and thereafter subjected to oxidizing treatment and further pickling.

14. A method of manufacturing the high strength cold rolled steel sheet according to claim 8, wherein a steel slab having the composition according to claim 1 is subjected to at least one pass of hot rolling at a hot rolling starting temperature of not lower than 1,000° C. but not higher than 1,300° C., a finish rolling temperature of not lower than 800° C. but not higher than 1,000° C. and a rolling reduction of not less than 35%, subsequently cooled in a temperature range from 700° C. to a cooling stop temperature under a condition of an average cooling rate of not lower than 5° C./s but not higher than 50° C./s to reach a cooling stop temperature of not higher than 600° C., then coiled at a coiling temperature of not less than 350° C. but not higher than 600° C., subsequently subjected to pickling and thereafter cold rolling at a cold rolling rate of not less than 30%, in a subsequent annealing step, retained at an annealing temperature of not lower than 750° C. but not higher than 900° C. for not less than 10 seconds but not more than 300 seconds, then cooled at a cooling rate of not less than 5° C./s to reach a cooling stop temperature of not lower than 300° C. but not higher than 450° C. and subsequently retained at the cooling stop temperature for not less than 10 seconds but not more than 1,800 seconds, and thereafter subjected to oxidizing treatment and further pickling.

* * * * *